US005891614A

United States Patent [19]

Ohzeki

[11] Patent Number: 5,891,614

[45] Date of Patent: Apr. 6, 1999

[54] SILVER HALIDE EMULSION AND SILVER HALIDE PHOTOGRAPHIC LIGHT-SENSITIVE MATERIAL USING THE SAME

[75] Inventor: Tomoyuki Ohzeki, Minami Ashigara, Japan

[73] Assignee: Fuji Photo Film Co., Ltd., Kanagawa, Japan

[21] Appl. No.: 837,413

[22] Filed: Apr. 18, 1997

[30] Foreign Application Priority Data

Apr. 18, 1996 [JP] Japan ..... 8-096883

[51] Int. Cl.[6] ..... G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 5,202,226 | 4/1993 | Saitou | 430/569 |
| 5,213,772 | 5/1993 | Ichikawa et al. | 430/245 |
| 5,254,454 | 10/1993 | Mimiya et al. | 130/569 |
| 5,637,446 | 6/1997 | Yamashita | 430/567 |
| 5,652,089 | 7/1997 | Saitou | 430/567 |

*Primary Examiner*—Mark F. Huff

[57] ABSTRACT

A silver halide emulsion is disclosed, comprising at least a dispersion medium and silver halide grains, wherein at least 30% of the entire projected area of the silver halide grains is occupied by tabular grains having {100} faces as major faces, an aspect ratio (diameter/thickness) of from 1.5 to 30 and a Br content of from 30 to 70 mol %, and the coefficient of variation of the halogen composition distribution among the silver halide grains is 10% or less. Further disclosed is a method for producing the silver halide emulsion.

9 Claims, No Drawings

SILVER HALIDE EMULSION AND SILVER HALIDE PHOTOGRAPHIC LIGHT-SENSITIVE MATERIAL USING THE SAME

FIELD OF THE INVENTION

The present invention relates to a high-sensitive and low-fog silver halide emulsion useful in the photographic field, a silver halide photographic emulsion using the same and a production method thereof. More specifically, the present invention relates to a silver halide emulsion capable of reducing development and fixing time as well as achieving low pollution. The present invention also relates to low replenishment and low wastes of the processing solution, a silver halide photographic light-sensitive material using the same and a production method thereof.

BACKGROUND OF THE INVENTION

In recent years, photographic materials are sought having various capabilities, improvement of sensitivity, storability and printing durability.

On the other hand, the need for simple and rapid development processing is also recently increasing, and low replenishment of the processing solution is a need of high priority. To cope with these requirements, use of a silver halide grain having a high solubility and a high silver chloride content is advantageous. For reducing the wastes, the image density is preferably increased with a small amount of silver. And, as well known in the art, a tabular grain is suitable for this in view of sensitivity, granularity, sharpness and color sensitization efficiency.

With respect to the tabular grain having a high silver chloride content, examples of the tabular grain having a {111} face on the major faces are described, for example, in JP-B-64-8326 (the term "JP-B" as used herein means an "examined Japanese patent publication"), JP-B-64-8325, JP-B-64-8324, JP-A-1-250943 (the term "JP-A" as used herein means an "unexamined published Japanese patent application"), JP-B-3-14328, JP-B-4-81782, JP-B-5-40298, JP-B-5-39459, JP-B-5-12696, JP-A-63-213836, JP-A-63-218938, JP-A-63-281149 and JP-A-62-218959.

However, when a large amount of sensitizing dyes are adsorbed to AgX grains, a grain having a {100} face usually exhibits better color sensitization property. Accordingly, development of the tabular grain having {100} faces as major faces is demanded. The {100} tabular grain having major faces in the right angled parallelogram shape is described in JP-A-51-88017, JP-B-64-8323, European Patent 0,534,395A1, U.S. Pat. Nos. 5,292,632, 5,264,337 and 5,320,938, JP-A-5-313273, JP-A-6-59360 and WO94/22051.

In order to increase the solubility and improve the processability, use of a silver halide grain having a high silver chloride content is advantageous, however, the silver chloride has an intrinsic wavelength region shorter in the wavelength than silver bromide and therefore, absorption of blue light and ultraviolet light is small and the grain is liable to be low sensitive. In the case of using the grain in a photographic light-sensitive material for medical X ray, needless to say about an UV emission screen and a regular system phosphor screen, a so-called ortho-system phosphor screen emits light in the blue and ultraviolet regions and therefore, the emulsion is naturally limited in the silver chloride content. Further, in the case of using the grain in a color light-sensitive material, the emulsion for use in a blue-sensitive layer is naturally limited in the silver chloride content.

In order to improve the processability without causing any reduction in the sensitivity to blue light, a mixed crystal of silver chloride and silver bromide is effective, however, formation of the mixed crystal is liable to invite broadening of the halogen composition distribution among silver halide grains and when the emulsion is dissolved, the aging stability may be worsened or softening may be caused.

The above-described publications of conventional technique describe a {100} tabular grain having a Br content in the vicinity of 50 mol %, however, they are quite unsatisfactory with respect to the {100} tabular grain having a narrow halogen composition distribution among grains and a Br content in the vicinity of 50 mol %.

SUMMARY OF THE INVENTION

An object of the present invention is to provide an AgX emulsion which exhibits excellent anisotropic growing property at a Br content in the vicinity of 50 mol %, grows at a very low rate in the thickness direction, is still more excellent in the monodispersibility of grains and the halogen composition distribution among grains, and is much more excellent in the sensitivity, the gradation, the spectral sensitivity characteristic and the processability.

Another object of the present invention is to provide a photographic light-sensitive material using the emulsion.

The objects of the present invention can be achieved by:

(1) a silver halide emulsion comprising at least a dispersion medium and silver halide grains, wherein 30% or more of the entire projected area of the silver halide grains is occupied by tabular grains having {100} faces as major faces, an aspect ratio (diameter/thickness) of from 1.5 to 30 and a Br content of from 30 to 70 mol %, and the coefficient of variation of the halogen composition distribution among grains is 10% or less;

(2) a silver halide emulsion as described in item (1), wherein the silver halide grain undergoes a tabular nucleus formation process due to the halogen composition gap, the tabular nucleus formation takes place at a pAg of from 8.0 to 10.0, and the growth is performed after the pAg is reduced to from 6.0 to 8.0;

(3) a silver halide emulsion as described in item (1) or (2), wherein the silver halide grain undergoes a tabular nucleus formation process due to the halogen composition gap and the tabular nucleus formation is enacted by the addition of silver halide fine grains;

(4) a silver halide emulsion as described in item (1), (2) or (3), wherein the growth of the silver halide grains is carried out by adding fine grains containing silver halide fine grains capable of being vanished by the completion of grain formation at a proportion of 90% or more in terms of number;

(5) a silver halide emulsion as described in item (1), (2) or (3), wherein the growth of the silver halide grains is carried out by adding fine grains containing silver halide fine grains capable of being vanished by the completion of grain formation at a proportion of 90% or more in terms of number, and on counting the fine grains added in order of larger volume, 50% or more by number of all the fine grains added are fine grains having a volume of from 10 to 100% based on the volume of a largest size fine grain capable of being vanished by the completion of grain formation;

(6) a silver halide emulsion as described in item (4) or (5), wherein the silver halide fine grains to be added at the growth of silver halide grains are continuously prepared in a mixer provided in the vicinity of a reaction vessel by feeding thereto a silver nitrate solution and a halogen salt solution, and continuously added to the reaction vessel immediately after the preparation;

(7) a silver halide emulsion as described in any one of items (2) to (6), wherein the silver halide fine grains to be added at the introduction of silver halogen gap is continuously added to a reaction vessel while continuously preparing them in a mixer provided in the vicinity of the reaction vessel by feeding thereto a silver nitrate solution and a halogen salt solution;

(8) a method for producing a silver halide emulsion comprising at least a dispersion medium and silver halide grains, wherein 30% or more of the entire projected area of the silver halide grains is occupied by tabular grains having {100} faces as major faces, an aspect ratio (diameter/thickness) of from 1.5 to 30 and a Br content of from 30 to 70 mol %, the coefficient of variation of the halogen composition distribution among grains is 10% or less, the silver halide grain undergoes a tabular nucleus formation process due to the halogen composition gap, the tabular nucleus formation takes place at a pAg of from 8.0 to 10.0, and the growth is performed after the pAg is reduced to from 6.0 to 8.0;

(9) a silver halide photographic light-sensitive material comprising a support having thereon at least one layer comprising the silver halide photographic emulsion described in any one of items (1) to (7);

(10) a silver halide photographic light-sensitive material comprising a support having on both sides thereof at least one layer comprising the silver halide photographic emulsion described in any one of items (1) to (7); and

(11) a silver halide photographic light-sensitive material as described in item (9) or (10), which is used in combination with a fluorescent intensifying screen which emits a light having a peak in a green light region, a blue light region or an UV light region upon exposure to X ray.

DETAILED DESCRIPTION OF THE INVENTION

The term "projected area of a tabular grain" as used herein means a projected area of a grain obtained when silver halide (AgX) emulsion grains are placed on a base plate not to lie one on another and to lay the major faces of the tabular grain in parallel with the base plate surface. The term "circle-corresponding diameter" of the tabular grain as used herein means a diameter of a circle having an area equal to the projected area of a grain obtained when the grain is observed through an electron microscope. The term "thickness" as used herein means a distance between major faces of the tabular grain. The aspect ratio is a value obtained by dividing the circle-corresponding diameter of the tabular grain by the thickness. The thickness is preferably from 0.02 to 0.5 $\mu$m, more preferably from 0.03 to 0.3 $\mu$m, still more preferably from 0.05 to 0.2 $\mu$m. The circle-corresponding projected grain size of the tabular grain is preferably from 0.1 to 10 $\mu$m, more preferably from 0.2 to 5 $\mu$m. The circle-corresponding diameter distribution is preferably monodisperse, and the coefficient of variation of the distribution is preferably from 0 to 0.4, more preferably from 0 to 0.3, still more preferably from 0 to 0.2. The coefficient of variation is a value obtained by dividing the distribution (standard deviation) of the grain size in terms of the circle-conversion diameter of a projected area of each grain, by the average grain size. The major face of the tabular grain preferably has a right angled parallelogram shape, and the major face edge length ratio [(long side length/short side length) of one grain] is preferably from 1 to 10, preferably from 1 to 5, more preferably from 1 to 2.

The AgX emulsion of the present invention comprises at least a dispersion medium and AgX grains, in which 30% or more, preferably from 60 to 100%, more preferably from 80 to 100% of the entire projected area of the silver halide grains is occupied by tabular grains having {100} faces as major faces, and an aspect ratio of from 1.5 to 30, preferably from 3 to 25, more preferably from 3 to 20.

The tabular grain for use in the present invention preferably has an AgX composition such that the Br content is from 30 to 70 mol %, preferably from 35 to 65 mol %, more preferably from 40 to 60 mol %. I (iodide) may be contained and the I content is preferably from 0 to 10 mol %, more preferably from 0 to 5 mol %. Other than Br and I, the halogen may be Cl.

The coefficient of variation of the halogen composition distribution among tabular grains for use in the present invention can be obtained as follows. The halogen composition of one silver halide grain can be measured using an EPMA (electron probe micro analyzer). The halogen composition draws a calibration curve from the intensity ratio of respective characteristic X rays of silver atom and halogen atom of a known silver halide grain, and from the calibration curve obtained, the halogen composition of one silver halide grain can be determined whatever halogen is used.

The coefficient of variation of the halogen composition distribution among silver halide grains for use in the present invention is preferably determined using Cl or Br as the halogen, and it is preferably from 0 to 10%, more preferably from 0 to 7.5%, more preferably from 0 to 6.5%.

The AgX emulsion of the present invention can be produced as follows. The tabular grain preferentially grows toward the edge direction and as a result, a tabular grain is obtained. The defect which enables the preferential growth is called a screw dislocation defect in the present invention. The defect is obtained by forming one or more, preferably from 1 to 3, more preferably 1 or 2 halogen composition gap faces at the time of nucleation (nucleus formation). The defect is preferably formed by laminating on an $AgX_1$ layer having a high solubility an $AgX_2$ layer having a solubility lower than that of the $AgX_1$ layer, inversely, laminating on an $AgX_1$ layer having a low solubility an $AgX_2$ layer having a solubility higher than that of the $AgX_1$ layer, and/or halogen converting a part or all of $AgX_1$ with $X_2$. In other words, the formation of halogen composition gap face accompanying the halogen conversion reaction is effective.

The solubility is in order of (high) AgCl >AgBr >AgI (low) and therefore, the higher the $Cl^-$ content and the lower the $I^-$ content, the higher the solubility. To state more specifically, in the nucleus formed at the time of nucleation, the halogen composition structure as the addition composition has a structure, for example, of ($AgX_1$|$AgX_2$) or ($AgX_1$|AgX4|$AgX_3$). The structure may be formed by simultaneously adding and mixing, for example, a silver salt solution (hereinafter referred to as "$Ag^+$ solution") and a halogen salt solution (hereinafter referred to as "$X^-$ solution"), and discontinuously varying the halogen composition of the $X^-$ solution at the site of a gap face. Further, the structure may be formed by adding an $X^-$ solution to a dispersion medium solution, adding $Ag^+$ solution to form $AgX_1$, adding another $X^-$ solution and then adding an $Ag^+$ solution, or by a combination method thereof. Furthermore, the structure may be formed by adding only $X^-$ after formation of $AgX_1$ and halogen-converting a part or all of the $AgX_1$. In a preferred embodiment, an $AgNO_3$ solution and an $X^-$ salt solution are fed to a mixing vessel provided in the vicinity of a reaction vessel to continuously prepare a fine grain emulsion and the emulsion is continuously added to the reaction vessel immediately after the preparation, or a fine grain emulsion previously prepared in a batch system in another vessel is continuously or discontinuously added. At least in forming $AgX_2$ or $AgX_4$, it is most preferred to feed an $AgNO_3$ solution and an $X^-$ salt solution to a mixing vessel provided in the vicinity of a reaction vessel to continuously prepare a fine grain emulsion and continuously add the emulsion to the reaction vessel immediately after the preparation.

In the fine grain emulsion addition method, an AgX fine grain emulsion having a grain size of from 0.006 to 0.15 μm, preferably from 0.006 to 0.1 μm, more preferably from 0.006 to 0.06 μm is added and the halogen gap face is formed by the halogen conversion due to Ostwald ripening. The fine grain emulsion may be added in the liquid state or as dry powder. The dry powder may be mixed with water immediately before the addition and added in the liquid state. The fine grains are preferably added in an embodiment such that the grains are vanished within 20 minutes, preferably within from 10 seconds to 10 minutes. If the vanishment time is prolonged, ripening is generated among the grains to increase the grain size and this is not preferred. Accordingly, it preferred not to add the grains in the entire amount at the same time. The fine grains preferably contain substantially no multiple twin plane grain. The term "substantially no" as used herein means that the number ratio of multiple twin plane grains is 5% or less, preferably 1% or less, more preferably 0.1% or less. Further, the fine grains preferably contain substantially no single twin plane grain. Furthermore, the fine grain preferably has no screw dislocation. The term "substantially no" as used herein follows the above-described provision. With respect to other details, JP-A-6-59360 can be referred to.

The halogen composition of $AgX_1$ is preferably close to the average halogen composition of a finally obtained silver halide grain, and the Br content is preferably from 30 to 70 mol %, more preferably from 35 to 65 mol %, still more preferably from 40 to 60 mol %. I (iodide) may be added and the I content is preferably from 0 to 10 mol %, more preferably from 0 to 5 mol %. Other than Br and I, Cl may be used as the halogen. $AgX_2$ and $AgX_4$ differ from $AgX_1$ in the $Cl^-$ or $Br^-$ content of the halogen composition by from 10 to 70 mol %, preferably from 20 to 70 mol %, more preferably from 30 to 70 mol %, and/or, if contained, in the $I^-$ content by from 5 to 100 mol %, preferably from 10 to 100 mol %, more preferably from 30 to 100 mol %. Or, an embodiment where difference in the $Cl^-$ or $Br^-$ content follows the above-described provision and difference in the $I^-$ content is from 0 to 5 mol %, may also be used.

With respect to the halogen composition of $AgX_2$ or $AgX_4$, a composition having a solubility higher than that of $AgX_1$ may be preferred but a composition having a solubility lower than that of $AgX_1$ is more preferred. In other words, the halogen composition of $AgX_2$ or $AgX_4$ preferably has a silver bromide content and a silver iodide content larger than those of $AgX_1$, most preferably contains substantially no silver chloride. The term "substantially no" as used herein means that $Br^-$, $I^-$ or the total of $Br^-$ and $I^-$ is added at the formation of $AgX_2$ or $AgX_4$ in an amount of 100 mol % or more based on the $Ag^+$ amount of $AgX_2$ or $AgX_4$. More specifically, $Cl^-$ (specifically, an aqueous Cl salt solution) or a silver halide fine grain emulsion containing $Cl^-$ may be added but in an amount such that $Cl^-$ is not contained in $AgX_2$ or $AgX_4$.

The halogen composition of $AgX_3$ is preferably close to the average halogen composition of a finally obtained silver halide grain, and the Br content is preferably from 30 to 70 mol %, more preferably from 35 to 65%, still more preferably from 40 to 60 mol %. I (iodide) may be contained but the I content is preferably from 0 to 10 mol %, more preferably from 0 to 5 mol %. Other than Br and I, Cl may be used as the halogen.

$AgX_1$ preferably has a size of 0.15 μm or less, more preferably from 0.01 to 0.1 μm.

With respect to the molar ratio of $AgX_1$:$AgX_2$ in the case of ($AgX_1$|$AgX_2$) or the molar ratio of $AgX_1$:$AgX_4$:$AgX_3$ in the case of ($AgX_1$|AgX4|$AgX_3$), a molar ratio capable of giving a most preferred embodiment of the present invention may be determined by varying the ratio in a manner of design of experiment and selected. In the case of ($AgX_1$|$AgX_2$), the thickness of the $AgX_2$ layer is preferably an amount of covering the surface of the $AgX_1$ layer by 1 lattice layer or more in average, more preferably from an amount of covering 3 lattice layers to $10^4$ times in mol the amount of the $AgX_1$ layer. In the case of ($AgX_1$|AgX4|$AgX_3$), the addition molar amount of the $AgX_4$ layer is preferably from 0.02 to 20 times in mol the addition amount of the $AgX_1$ layer, more preferably from 0.1 to 10 times in mol. Usually, as the gap difference is larger, the frequency of defect formation is higher.

In a preferred embodiment of the present invention, the dispersion medium solution at the time of $AgX_1$ nucleus formation preferably has a pAg of from 6 to 10, more preferably from 6 to 8. The pAg as used herein is defined by the equation: pAg=−log[mol of $Ag^+$ per liter]. At the time of halogen gap in the tabular nucleus formation of $AgX_2$ or $AgX_4$, the pAg is preferably from 8 to 10, more preferably from 9 to 10, and preferably higher than the pAg at the time of $AgX_1$ nucleus formation. In order to achieve a high pAg value at the time of halogen gap in the tabular nucleus formation of $AgX_2$ or $AgX_4$, adjustment by the addition amount of the aqueous halogen salt solution corresponding to $X_2$ or $X_4$ is preferably used, or an aqueous halogen salt solution may be added separately from $X_2$ or $X_4$. In the period between after the halogen gap in the tabular nucleus formation of $AgX_2$ or $AgX_4$ and before the growth, the pAg is preferably returned to from 6 to 8, preferably from 6 to 7, or to a pAg lower than that at the time of halogen gap in the tabular nucleus formation of $AgX_2$ or $AgX_4$. In order to reduce the pAg in the period between after the halogen gap in the tabular nucleus formation of $AgX_2$ or $AgX_4$ and before the growth, the adjustment is preferably performed by adding an aqueous silver nitrate solution in the case of ($AgX_1$|$AgX_2$), or by the addition amount of an aqueous silver nitrate solution of $AgX_3$ in the case of ($AgX_1$|$AgX_4$|$AgX_3$). Adjustment may also be preferably performed by adding an aqueous silver nitrate solution separately from the silver nitrate of $AgX_3$.

In a preferred embodiment of the present invention, a pH in almost all normal conditions (pH: 1 to 9) may be used, however, in the region of pH 1 to 7, as the pH elevates, the frequency of defect formation increases. When a large number of defects are introduced into one grain, the population of grains having a large thickness increases in the finally obtained AgX emulsion. Accordingly, introduction of too many defects is not preferred. The conditions in forming the defects must be selected so that the finally obtained AgX emulsion falls within the embodiment of the present invention. The embodiment of the present invention may be obtained when the gap faces are formed uniformly among nuclei.

The dispersion medium solution at the time of nucleation preferably has a dispersion medium concentration of from 0.1 to 10 wt %, more preferably from 0.3 to 5 wt %. The temperature is preferably from 10 to 80° C., more preferably from 30° to 60° C. In many cases, as the temperature at the time of gap face formation is reduced to lower than 30° C., the frequency of defect formation decreases. This reveals that the temperature at the time of defect formation needs be higher than a certain degree.

At the time of nucleation, a dispersion medium may be added to a silver salt solution and/or an $X^-$ salt solution added so as to enable uniform nucleation. The dispersion medium concentration is preferably 0.1 wt % or more, more preferably from 0.1 to 2 wt %, still more preferably from 0.2 to 1 wt %. A low molecular weight gelatin having a molecular weight of from 3,000 to 60,000, preferably from 8,000 to 40,000, is preferred. Further, the $Ag^+$ solution and the $X^-$ solution are preferably added directly to the solution though a porous addition system having an addition pore number of from 3 to 1015, preferably from 30 to $10^{15}$. The details thereof are described in JP-A-3-21339, JP-A-4-193336 and Japanese Patent Application No. 4-240283 (JP-A-6-88923). As the gelatin has a lower methionine content, the frequency of defect formation increases. A most preferred gelatin may be selected from the gelatins having a methionine content of from 1 to 60 $\mu$mol depending on the case.

By reducing the excessive $X^-$ salt concentration or the excessive $Ag^+$ salt concentration at the time of nucleation, the mixing ratio of twin plane grains may be lowered. The mixing ratio increases as the dispersion medium concentration is reduced or the stirring level is worsened. The conditions may be selected by try-and-error so that the finally obtained grain falls within the embodiment of the present invention.

After forming screw dislocation defects as a result of formation of halogen composition gap faces and halogen conversion reaction at the interface during the nucleation, the temperature is elevated preferably by 10° C. or higher, more preferably by from 20° to 70° C. to ripen the grains. The ripening is preferably performed in an atmosphere of {100} face formation and the ripening conditions may be selected from the above-described nucleation conditions. In the ripening, tabular grains are preferentially grown and non-tabular grains are vanished to increase the tabular grain ratio. The ripening rate increases, in the region of pH 1 to 6, as the pH elevates, or in the region of pCl 1 to 3, as the $Cl^-$ concentration increases. The ripening is preferably not performed until fine grains all are vanished. When the fine grains all are vanished, corners of the tabular grain are dissolved out and grains reduced in the anisotropic growing property come out into the presence. Accordingly, the growth is preferably started while fine grains are still present.

In the present invention, the anisotropic growth is performed by AgX fine grains capable of being vanished. In order to enable growing of the tabular grain while maintaining the anisotropic growing property, it is essential to perform the growth under conditions of not causing dissolving of the tabular grain itself and at the same time, under low super-saturation. Accordingly, the fine grain added preferably has a maximum size capable of being vanished by the completion of grain formation (hereinafter referred to as a "critical fine grain"). In the fine grain addition method, the supersaturation degree is determined by the solubility of grain and therefore, as the grain size is larger, the low supersaturation state is more realized and at the same time, due to the presence of fine grains, dissolution of the tabular grain itself is not caused. Accordingly, in the fine grains added, preferably 90% or more, more preferably 95% or more, still more preferably 100% of all the grains are the critical fine grains or smaller than that and preferably have a volume of from 70 to 100%, more preferably from 80 to 100%, still more preferably from 90 to 100% of the volume of the critical fine grain or smaller grain. The above-described fine grains preferably account for, in terms of the number of grains counted in order of larger volume, 50% or more, more preferably 70% or more, still more preferably 85% or more, of all the fine grains. The size of the critical fine grain increases as the size of the {100} tabular grain is larger and therefore, the size of fine grains added needs be gradually increased at the time of growth. The size of fine grains which are vanished varies depending on the halogen composition of AgX fine grain, the pH, the pAg, the gelatin temperature or the AgX solvent concentration. Therefore, the size of critical fine grain must be determined according to various timings during the growth.

The size of critical fine grain may be determined by a try-and-error method where the procedure of adding and growing previously prepared fine grains having various known sizes and a coefficient of variation of the grain size of about 0.1 to {100} tabular grains having a known size is repeated. The fine grain has a grain size of 0.15 $\mu$m or less, preferably 0.1 $\mu$m or less, more preferably from 0.06 to 0.006 $\mu$m.

The fine grain emulsion is preferably always added during the growth, however, when the fine grains in a proportion corresponding to preferably 5% or more, more preferably 10% or more of the growing silver amount are the above-described fine grains, the emulsion of the present invention can be obtained. The fine grain emulsion may be added either continuously or discontinuously. The fine grain emulsion may be added continuously or discontinuously after previously preparing it in a batch system in a separate vessel or may be added as dry powder. In the present invention, it is most preferred to feed an $AgNO_3$ solution and an $X^-$ salt solution to a mixing vessel provided in the vicinity of a reaction vessel to continuously prepare the fine grain emulsion and continuously add the emulsion to the reaction vessel immediately after the preparation.

The size of the fine grain is determined by photographing a grain by a direct method low temperature transmission-type electron microscope (hereinafter referred to as a "direct TEM method") and measuring it. The fine grains preferably contain substantially no multiple twin plane grain. The term "multiple twin plane grain" as used herein means a grain having two or more twin planes per one grain. The term "substantially no" as used herein means that the number ratio of multiple twin plane grains is 5% or less, preferably 1% or less, more preferably 0.1% or less. Further, the fine grains preferably contain substantially no single twin plane grain. Furthermore, the fine grain preferably has substantially no screw dislocation. The term "substantially no" as used herein follows the above-described provision.

The halogen composition of the fine grain is preferably close to the average halogen composition of a finally obtained silver halide grain, and the Br content is preferably from 30 to 70 mol %, more preferably from 35 to 65 mol %, still more preferably from 40 to 60 mol %. I (iodide) may be contained and the I content is preferably from 0 to 10 mol %, more preferably from 0 to 5 mol %. Other than Br and I, Cl may be used as the halogen.

An example of the direct TEM method is described below.

1. Preparation of Sample

An emulsion during the grain formation and/or after the grain formation was added to a methanol solution of phenyl mercaptotetrazole ($1\times10^{-3}$ to $1\times10^{-2}$ mol/mol-Ag) so as not to cause deformation of grains, and the grains were taken out by centrifugal separation, dripped on a base (mesh) for supporting a sample for electron microscopic observation, previously attached with a carbon support film, and then dried to prepare a sample.

2. Observation of Grain

The thus-prepared sample was observed through an electron microscope JEM-2000FXII manufactured by Nippon Denishi KK, at an accelerated voltage of 200 kV and a magnification of from 5,000 to 50,000 using a sample cooling holder 626-0300 Cryostation manufactured by GATAN at an observation temperature of −120° C.

The tabular grain of the present invention is grown by adding an $Ag^-$ salt and a halogen salt at an addition rate where new nuclei are generated and simultaneously, the new nuclei do not grow to a critical fine grain. The new nuclei are preferably present in a grain number of 2 times or more, more preferably 5 times or more, still more preferably 10 times or more the {100} tabular grain number. The reason why generation of new nuclei is preferred is that dissolution of the tabular grain is not caused due to the generation of new nuclei and the anisotropic growing property of the grain can be maintained. Also, reduction of the supersaturation degree in the system as a result of generation of new nuclei is a factor of capability of the grain to maintain its anisotropic growing property. The generation of new nuclei, the number of new nuclei and the fact that grains larger than the size of critical fine grain can be verified by the direct TEM method applied to a sample which is not subjected to centrifugal separation upon preparation of the sample. The addition rate of causing generation of new nuclei and not allowing the new nuclei to grow to the size of critical fine grain varies depending on the halogen composition added, the pH, the pAg, the kind of gelatin, the gelatin concentration, the temperature, the AgX solvent concentration or the size of {100} tabular grain. Accordingly, the addition rate must be determined according to various timings in the growth by the try-and-error method. Usually, as the pCl value is larger, the addition rate satisfying the conditions can be realized over a broader region of addition rate. The new nucleus is preferably generated at all times, but when new nuclei are generated only at the time of addition corresponding to preferably 5% or more, more preferably 10% or more of the grown silver amount, the emulsion of the present invention can be obtained. However, also in this case, nuclei generated in a new nucleus must be present when the Ag salt is being added.

The dispersion medium for use in the nucleation, the ripening or the growth may be a conventionally known dispersion medium for AgX emulsion. A gelatin having a methionine content of preferably from 0 to 50 μmol/g, more preferably from 0 to 30 ρmol/g is preferably used. When this gelatin is used in the ripening or the growth, thin tabular grains uniform in the diameter size distribution are advantageously formed. The synthetic polymers described in JP-B-52-16365, *Nippon Shashin Gakkai Shi* (*Journal of Japan Photographic Society*), Vol. 29 (1), 17, 22 (1966), ibid., Vol. 30 (1), 10, 19 (1967), ibid., Vol. 30 (2), 17 (1967), and ibid., Vol. 33 (3), 24 (1967), may also be preferably used as the dispersion medium. Further, the crystal habit controlling agent described in European Patent 0534395A1 may be used in combination. The dispersion medium concentration is preferably from 0.1 to 10 wt %, and the controlling agent is preferably used in an amount of from $10^{-1}$ to $10^{-6}$ mol/l, more preferably from $10^{-2}$ to $10^{-5}$ mol/l. The dispersion medium may be added at any stage between before the nucleation and at the completion of growth. Further, the dispersion medium may be added additionally to the existing dispersion medium or may be added after removing the existing dispersion medium by centrifugal separation or the like.

With respect to the range of pH or $X^-$ salt concentration, those described above for the nucleation may be used. The temperature is preferably 25° C. or higher, more preferably from 30 to 80° C. The growth is also preferably performed in a {100} face formation atmosphere.

The {100} face formation atmosphere indicates the condition, out of various conditions in the nucleation, the ripening and the growth, such that from 60 to 100%, preferably from 80 to 100%, more preferably from 90 to 100% of the grain surface have a {100} face. The surface ratio can be determined by the method described in T. Tani, *Journal of Imaging Science*, Vol. 29, 165 (1985).

The grain is preferably ripened and/or grown in the conditions such that the pCl is 1.6 or more, preferably from 1.6 to 2.5, and the temperature is 65° C. or higher, preferably from 65° to 80° C.

In the silver halide emulsion of the present invention, all or a part of the grain surface is preferably subjected to halogen conversion in respective steps of from the grain growth to the chemical sensitization. The halogen conversion may be applied by using an aqueous bromide salt such as potassium bromide or sodium bromide or an aqueous iodide salt such as potassium iodide individually or in combination. The salt solid may be added as it is or as an aqueous solution or a gelatin dispersion. Further, fine grains of silver halide such as silver bromide, silver iodobromide or silver iodide may also be preferably added. These may be used either individually or in combination. When fine grains are added, the fine grain preferably has an average sphere-corresponding diameter of 0.1 μm or less, more preferably 0.05 μm or less. The fine grain may be continuously prepared by feeding an aqueous silver nitrate solution and an alkali halide solution having any composition to a mixing machine provided in the vicinity of a reaction vessel and immediately added to the reaction vessel, or may be previously prepared in a separate vessel in a batch system and then added to a reaction vessel. The silver halide grain may contain, if desired, a noble metal ion or compound such as iridium, rhodium, platinum or yellow prussiate of potash.

With respect to the time of halogen conversion in the present invention, the halogen conversion is preferably performed at least before adding a spectral sensitizing dye. The amount of halogen conversion is, in terms of silver amount, 20 mol % or less, preferably 10 mol % or less, more preferably 5 mol % or less, but $1\times10^{-3}$ mol % or more, based on the silver halide grain, though it may vary depending on the halogen composition subjected to the halogen conversion.

In the tabular grain for use in the present invention, the major face is a {100} face, and $Ag^+$ and $X^-$ are alternately arrayed. When a spectral sensitizing dye is adsorbed to the plane, the dye may interact directly with the $Ag^+$. $Ag^+$ of the AgX grain constitutes the conduction band and $X^-$ constitutes the charging band. Accordingly, the minimum valent site level of the dye can interact directly with the conduction band of the AgX grain. As a result, upon photo-exciting of the dye, the electron inrush efficiency to the AgX conduction band is good and thereby, a high spectral sensitization efficiency can be achieved. On the other hand, in the tabular grain having major faces of {111} face, the dye can but interact with the conduction band of the AgX grain only through the $X^-$ layer. The $X^-$ layer on the front surface has cutting of bonds on the surface thereof and bears excessive negative charges, and therefore, the electron must get over this negative charge barrier to inrush and the electron inrush efficiency is bad. Accordingly, the {100} face-type tabular grain is more excellent in the spectral sensitization efficiency than the conventional {111} face-type tabular grain. Further, when the {111} face-type tabular grain is photo-excited by light in the intrinsic region, the positive hole generated is prone to capture into the maximum occupied orbit of the dye through the $X^-$ layer on the front surface and re-bonds to the excitation electron to readily cause so-called intrinsic desensitization. This is because the positive hole is easily trapped by the $X^-$ layer on the front surface. The {100} face-type tabular grain is greatly saved from this.

The tabular grain for use in the present invention is a silver halide grain having a dislocation line. The dislocation line of the tabular rain can be observed by a direct method using a transmission-type electron microscope at a low temperature described, for example, in J. F. Hamilton, *Phot. Sci. Eng.,* 11, 57 (1967) and T. Shiozawa, *J. Soc. Phot. Sci. Japan,* 35, 213 (1972). More specifically, a silver halide grain taken out from an emulsion carefully so as not to apply such a pressure as to cause generation of dislocation on the grain is placed on a mesh for observation by an electron microscope and observed according to a transmission method while laying the sample in a cool state so as to prevent any damage (e.g., print out) by the electron beams. At this time, as the thickness of the grain is larger, the electron beams are more difficult to transmit and therefore, a high voltage-type (200 kv or more to the grain having a thickness of 0.25 $\mu$m) electron microscope is preferably used to achieve clearer observation. The site and the number of dislocation lines on each grain can be determined by observing the grain from the direction perpendicular to the major face on the photograph of the grain obtained as above.

The silver halide grain for use in the present invention is usually chemically sensitized. The chemical sensitization method which can be used includes those described in JP-A-2-68539, page 10, from right upper column, line 13 to left upper column, line 16, and JP-A-5-313282.

The conditions for the chemical sensitization in the L present invention are not particularly restricted, however, the pAg is from 6 to 11, preferably 7 to 10, and the temperature is from 40° to 95° C., preferably from 45° to 85° C.

The chemical sensitization in the present invention is performed using chalcogen sensitization such as sulfur sensitization, selenium sensitization or tellurium sensitization in combination with gold sensitization. In the silver halide emulsion of the present invention, the grain is preferably sensitized at least with the selenium compound.

In the sulfur sensitization, a labile sulfur compound is used and the labile sulfur compounds described in P. Grafkides, *Chimie et Physique Photographique,* 5th ed., Paul Montel (1987), and *Research Disclosure*, Vol. 307, No. 307105 may be used. Specific examples thereof include known sulfur compounds such as thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethyl-rhodanine), phosphine sulfides (e.g., trimethylphosphine sulfide), thiohydantoins, 4-oxo-oxazolidine-2-thiones, dipolysulfides or polysulfides (e.g., dimorpholine disulfide, cystine, lenthionine), mercapto compounds (e.g., cystane), polythionates and elemental sulfur, and activated gelatin.

In the selenium sensitization, a labile selenium compound is used and the labile sensitizers described in JP-B-43-13489, JP-B-44-15748, JP-A-4-25832, JP-A-4-109240, JP-A-4-271341 and JP-A-5-40324 may be used. Specific examples thereof include colloidal metal selenium, selenoureas (e.g., N,N-dimethylselenourea, trifluoromethylcarbonyl-trimethylselenourea, acetyl-trimethylselenourea), selenoamides (e.g., selenoacetamide, N,N-diethylphenylselenoamide), phosphine selenides (e.g., triphenylphosphine selenide, pentafluorophenyl-triphenylphosphine selenide), selenophosphates (e.g., tri-p-tolylselenophosphate, tri-n-butylselenophosphate), selenoketones (e.g., selenobenzophenone), isoselenocyanates, selenocarboxylic acids, selenoesters and diacyl selenides. Further, non-labile selenium compounds such as selenious acid, potassium selenocyanate, selenazoles and selenides, described in JP-B-46-4553 and JP-B-52-34492 can also be used.

In the tellurium sensitization, a labile tellurium compound is used and the labile tellurium compounds described in Canadian Patent 800,958, British Patents 1,295,462 and 1,396,696, JP-A-4-204640, JP-A-4-271341, JP-A-4-333043 and JP-A-5-303157 may be used. Specific examples thereof include telluroureas (e.g., tetramethyltellurourea, N,N'-dimethylethylenetellurourea, N,N'-diphenylethylenetellurourea), phosphine tellurides (e.g., butyl-diisopropylphosphine telluride, tributylphosphine telluride, tributoxyphosphine telluride, ethoxy-diphenylphosphine telluride), diacyl (di)tellurides (e.g., bis(diphenylcarbamoyl) ditelluride, bis(N-phenyl-N-methylcarbamoyl) ditelluride, bis(N-phenyl-N-methylcarbamoyl) telluride, bis(ethoxycarbonyl) telluride), isotellurocyanates, telluroamides, tellurohydrazides, telluroesters (e.g., butylhexyltelluroester), telluroketones (e.g., telluroacetophenone), colloidal tellurium, (di)tellurides and other tellurium compounds (e.g., potassium telluride, sodium telluropentathionate).

In the gold sensitization, the gold salts described in P. Grafkides, *Chimie et Physique Photographique*, (supra) 5th ed., Paul Montel (1987), and *Research Disclosure*, Vol. 307, No. 307105 may be used. Specific examples thereof include chloroauric acid, potassium chloroaurate, potassium aurithiocyanate, gold sulfide, gold selenide, gold compounds described in U.S. Pat. Nos. 2,642,361, 5,049,484 and 5,049,485. A noble metal salt such as platinum, palladium and iridium may also be added.

The chalcogen sensitizations may be performed individually or in combination of two or more thereof, or may be performed in combination with gold sensitization. The combination of selenium sensitization and gold sensitization is most preferred, and the combination of sulfur sensitization and selenium sensitization with gold sensitization is also preferred. Further, the combination with reduction sensitization may also be used.

The use amount of the chalcogen sensitizer for use in the present invention may vary depending on the silver halide grain used or the chemical sensitization conditions, however, it is approximately from $10^{-8}$ to $10^{-2}$ mol, preferably from $10^{-7}$ to $5\times10^{-3}$ mol, per mol of silver halide.

The use amount of the gold sensitizer or the noble metal sensitizer for use in the present invention is approximately from $10^{-7}$ to $10^{-2}$ mol per mol of silver halide. The conditions of chemical sensitization in the present invention are not particularly restricted, however, the pAg is preferably from 6 to 11, more preferably from 7 to 10, the pH is preferably from 4 to 10, and the temperature is preferably from 40° to 95° C., more preferably from 45° to 85° C.

In the reduction sensitization, known reducing compounds described in P. Grafkides, *Chimie et Physique Photographique*, (supra) 5th ed., Paul Montel (1987), and *Research Disclosure*, Vol. 307, No. 307105 may be used. Specific examples thereof include aminoiminomethanesulfinic acids (also called thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfite, aldehyde compounds and hydrogen gas. Further, the reduction sensitization may be performed in a high pH atmosphere or in an excessive silver ion atmosphere (so-called silver ripening).

In the process of grain formation or physical ripening of the silver halide grain, a cadmium salt, a zinc salt, a lead salt, a thallium salt, an indium salt or a complex salt thereof, a rhodium salt or a complex salt thereof, or an iron salt or a complex salt thereof may be present together.

In addition, impurity ions may be doped to the entire of an AgX grain, doped to a specific site within an AgX grain, or localized and doped within the region of 0.1 $\mu$m from the grain surface. In this case, the doping concentration is preferably from $10^{-8}$ to $10^{-1}$ mol/mol-AgX, more preferably from $10^{-7}$ to $10^{-2}$ mol/mol-AgX.

The specific compound examples and the doping method to the AgX phase of the impurity ion are described in detail in *Research Disclosure*, Vol. 307, Item 307105 (November, 1989), U.S. Pat. Nos. 5,166,045, 4,933,272, 5,164,292, 5,132,203, 4,269,927, 4,847,191, 4,933,272, 4,891,781 and 5,024,931, JP-A-4-305644, JP-A-4-321024, JP-A-1-183647, JP-A-2-20853, JP-A-1-285941 and JP-A-3-118536.

A {100} face formation accelerating agent may be present together during the growth of grain. A crystal habit controlling agent indicates a compound which increases due to the above-described co-presence, the equilibrium crystal habit potential of the Agx grain produced by 10 mV or more, preferably from 30 to 200 mV.

Specific compound examples thereof include those described in U.S. Pat. Nos. 4,399,215, 4,414,306, 4,400,463, 4,713,323, 4,804,621, 4,783,398, 4,952,491 and 4,983,508, *Journal of Imaging Science*, Vol. 33, 13 (1989), *ibid.*, Vol. 34, 44 (1990), and *Journal of Photographic Science*, Vol. 36, 182 (1988).

Most of the grains have {100} faces and therefore, the adsorptive group (for example, methionine group) of gelatin strongly adsorbs to the $Ag^+$ on the grain surface. As a result, adsorption of a spectral sensitizing dye, an antifoggant or other photographic additives may be prohibited. In such a case, a dispersion medium gelatin having an optimal methionine content may be selected. More specifically, the gelatin in the AgX emulsion layer of a light-sensitive material preferably has an average methionine content of from 0 to 50 $\mu$mol/g, more preferably from 3 to 30 $\mu$mol/g.

To the AgX emulsion, a chemical sensitizer in an amount of from $10^{-2}$ to $10^{-8}$ mol/mol-AgX and a sensitizing dye in an amount of from 5 to 100% of the saturation adsorption amount may be added to perform sensitization.

Using the grain obtained as a host grain, epitaxial grains may be formed at the edges and/or corners of the grain. In addition, using the grain above as a substrate, an AgX layer having a halogen composition different from that of the substrate may be laminated thereon, then various known grains. having various grain structures may be prepared. These are describes in the publications which will be set forth later. The emulsion grain obtained is usually imparted with a chemical sensitization nucleus.

In this case, the generation site and the number/cm$^2$ of chemical sensitization nuclei are preferably controlled. This is described in JP-A-2-838, JP-A-2-146033, JP-A-1-201651, JP-A-3-121445, JP-A-,64-74540, and Japanese Patent Application No. 3-73266 (JP-A-4-308840), 3-140712 (JP-A-5-313270) and 3-115872 (JP-A-4-343348).

The emulsion of the present invention is usually spectrally sensitized and examples of the dye used include a cyanine dye, a merocyanine dye, a complex cyanine dye, a complex merocyanine dye, a holopolar cyanine dye, a hemicyanine dye, a styryl dye and a hemioxonol dye. Among these, particularly useful are dyes belonging to the cyanine dye, the merocyanine dye and the complex merocyanine dye. To these dyes, any nucleus commonly used for the cyanine dyes as a basic heterocyclic nucleus can be applied. Examples thereof include a pyrroline nucleus, an oxazoline nucleus, a thiazoline nucleus, a selenazoline nucleus, a pyrrole nucleus, an oxazole nucleus, a thiazole nucleus, a selonazolo nucleus, an imidazole nucleus, a tetrazole nucleus and a pyridine nucleus; a nucleus resulting from fusion of an alicyclic hydrocarbon ring to the above-described nuclei; and a nucleus resulting from fusion of an aromatic hydrocarbon ring to the above-described nuclei, e.g., indolenine nucleus, benzindolenine nucleus, indole nucleus, benzoxazole nucleus, naphthoxazole nucleus, benzimidazole nucleus, naphthoimidazole nucleus, benzothiazole nucleus, naphthothiazole nucleus, benzoselenazole nucleus, naphthoselenazole, nucleus, quinoline nucleus and benzotellurazole nucleus. These heterocyclic nuclei each may have a substituent on the carbon atom thereof.

To the merocyanine dye or complex merocyanine dye, any of the nuclei commonly used in the merocyanine dye may be applied as a nucleus having a ketomethylene structure. Examples of particularly useful nuclei include 5- and 6-membered heterocyclic nuclei such as pyrazolin-5-one nucleus, thiohydantoin nucleus, 2-thioxazolidin-2,4-dione nucleus, thiazolidin-2,4-dione nucleus, rhodanine nucleus, thiobarbituric acid nucleus and 2-thioseleanazolidin-2,4-dione nucleus.

These sensitizing dyes may be used individually or in combination thereof. The combination of sensitizing dyes is often used for the purpose of supersensitization. Representative examples thereof are described in U.S. Pat, Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862 and 4,026,707, British Patents 1,344,281 and 1,507,803, JP-B-43-4936, JP-B-53-12375, JP-A-52-110618 and JP-A-52-109925.

In combination with the sensitizing dye, a dye which itself provides no spectral sensitization effect or a material Which absorbs substantially no visible light, but which exhibits remarkable increase of spectral sensitization when combined with the sensitizing dye, that is, any of the compounds called supersensitizer may used. Representative examples of the supersensitizer include bispyridinium salt compounds described in JP-A-59-142541, stilbene derivatives described in JP-B-59-18691, water-soluble bromide and water-soluble iodides such as potassium bromide and potassium iodide described in JP-B-49-46932, condensates of an aromatic compound with formaldehyde described in U.S. Pat. No. 3,743,510, cadmium salts and azaindene comapounds.

The sensitizing dye is added after chemical ripening or before chemical ripening. To the silver halide grain for use in the present invention, the sensitizing dye is most preferably added during chemical ripening or before chemical ripening (for example, at the grain formation or physical ripening).

The photographic emulsion of the present invention may contain various compounds so as to prevent fogging during production, storage or photographic processing of the light-sensitive material or to stabilize the photographic capacity. More specifically, a large number of compounds known as an antifoggant or a stabilizer may be added, for example, azoles such as benzothiazolium salt, nitroindazoles, triazoles, benzotriazoles and benzimidazoles (particularly, nitro- or halogen-substitution product); heterocyclic mercapto compounds such as mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; the above-described heterocyclic mercapto compounds having a water-soluble group such as a carboxyl group or a sulfone group; thioketo compounds such as oxazolinethione; azaindenes such as tetrazaindenes (particularly, 4-hydroxy-substituted-(1,3,3a,7)tetrazaindenes); benzenethiosulfonic acids; and benzenesulfinic acids.

The emulsion layer for use in the present invention may contain a thiocyanic acid compound in an amount of from $1.0\times10^{-3}$ mol to less than $2.0\times10^{-2}$ mol per mol of silver. The thiocyanic acid compound may be added at any stage of the grain formation, the physical ripening, the grain growth, the chemical sensitization and the coating, however, preferably added before chemical sensitization.

As the thiocyanic acid compound used in the preparation of the silver halide emulsion of the present invention, a water-soluble salt such as a metal salt or an ammonium salt of thiocyanic acid may be generally used, however, in the case of using a metal salt, a care must be taken to use the metal element so as not to adversely affect the photographic capability, and a potassium salt or a sodium salt is preferred. A sparingly soluble salt such as AgSCN may also be added in the form of a fine particle.

The above-described antifoggant or stabilizer is usually added after the chemical sensitization is applied, however, it is more preferably added during chemical ripening or in the period before initiation of chemical ripening.

The AgX emulsion grain produced by the method of the present invention may be blended with one or more of other AgX emulsions before use. An optimal blending ratio may be appropriately selected from the range of from 1.0 to 0.01.

In the present invention, the chemical sensitization may be preferably performed by letting a nucleic acid or a decomposition product thereof be present before completion of the chemical sensitization. The nucleic acids and the decomposition products described in JP-A-62-67541 may be used. The nucleic acid for use in the present invention includes deoxyribonucleic acid (DNA) and ribonucleic acid (RNA), and the nucleic acid decomposition product includes those under decomposition and simple substances such as adenine, guanine, uracil, cytosine and thymine. A particularly preferred nucleic acid decomposition product is adenine. These may be used individually or in combination. In this case, a nucleic acid may of course be used in combination with a nucleic acid decomposition product. The addition amount of the nucleic acid or the decomposition product thereof varies depending on the kind of the nucleic acid or the nucleic acid decomposition product, however, it is usually 20 mg or more, preferably from 100 mg to 1 g, per mol of silver halide. When these nucleic acids and the decomposition products thereof are used individually or in combination of two or more thereof, the total addition amount may suffice if it falls within the above-described range.

The light-sensitive material of the present invention preferably uses a polymer latex obtained by polymerizing a sparingly soluble monomer described below. The monomer for use in the present invention is described.

The monomer is preferably an acrylic ester-base compound. More preferably, an acrylic ester-base compound and a methacrylic ester-base compound both are used. The polymer latex preferably has a grain size of 300 nm or less.

The polymer latex is preferably polymerized in the presence of a water-soluble polymer and/or a surface active agent.

The surface active agent for use in the polymerization of the polymer latex may be any of an anionic surface active agent, a nonionic surface active agent, a cationic surface active agent and an amphoteric surface active agent, however, an anionic surface active agent and/or a nonionic surface active agent are preferably used. As the anionic surface active agent or the nonionic surface active agent, various compounds known in the art may be used, but preferably, an anionic surface active agent may be used.

Examples of the water-soluble polymer for use in the polymerization of the polymer latex include a synthetic polymer and a natural water-soluble polymer, and either may be preferably used in the present invention. The synthetic water-soluble polymer includes those having in the molecular structure, for example, a nonionic group, an anionic group, a cationic group, a nonionic group and an anionic group, a nonionic group and a cationic group, or an anionic group and a cationic group. Examples of the nonionic group include an ether group, an alkylene oxide group, a hydroxy group, an amide group and an amino group. Examples of the anionic group include a carboxylic acid group and a salt thereof, a phosphoric acid group and a salt thereof, and a sulfonic acid group and a salt thereof. Examples of the cationic group include a quaternary ammonium salt group and a tertiary amino group.

The natural water-soluble polymer includes those having in the molecular structure, for example, a nonionic group, an anionic group, a cationic group, a nonionic group and anionic group, a nonionic group and a cationic group, or an anionic group and a cationic group.

The water-soluble polymer for use in the polymerization of the polymer latex, in either case of a synthetic water-soluble polymer or a natural water-soluble polymer, is preferably a water-soluble polymer having an anionic group or a water-soluble polymer having a nonionic group and an anionic group.

The water-soluble polymer may be sufficient if it has a solubility in 100 g of water at 20° C., of 0.05 g or more, preferably 0.1 g or more.

Examples of the natural water-soluble polymer includes those described in detail in *Sogo Gilutsu Shiro Shu* (*General Technical Data*)*of Water-Soluble Polymer Water Dispersion Resin*, Keiei Kaihatsu Center, and preferred are lignin, starch, pulluran, cellulose, dextran, dextrin, glycogen, alginic acid, gelatin, collagen, guar gum, gum arabi, laminarin, lichenin, niglan and a derivative thereof. Preferred examples of the natural water-soluble polymer derivative include those sulfonated, carboxylated, phosphorated, formed into a sulfoalkylene, formed into a carboxyalkylene, or alkylphosphorated, and a salt thereof. Among these, particularly preferred are glucose, gelatin, dextran, cellulose and a derivative thereof.

The polymer latex may be easily produced by various methods. Examples of the method include an emulsion polymerization method and a method of redispersing a polymer obtained by solution polymerization or block polymerization.

In the emulsion polymerization method, water is used as a dispersion medium, a monomer in an amount of from 10 to 50 wt % based on the water, from 0.05 to 5 wt % of a polymerization initiator based on the monomer and from 0.1 to 20 wt % of a dispersant are used, and the polymerization is performed at from about 30° to 100° C., preferably from 60° to 90° C., for from 3 to 8 hours under stirring. The monomer concentration, the amount of initiator, the reaction temperature and the time may be easily changed over a wide range.

Examples of the polymerization initiator include water-soluble peracids (e.g., potassium persulfate, ammonium persulfate) and water-soluble azole compounds (e.g., 2,2'-azobis(2-aminodipropane)-hydrochloride).

Examples of the dispersant include a water-soluble polymer, an anionic surface active agent, a nonionic surface active agent, a cationic surface active activate agent and an amphoteric surface active agent, and these may be used either individually or in combination. A combination use of a water-soluble polymer and a nonionic surface active agent or an anionic surface active agent is preferred. In the solution polymerization, generally, a monomer mixture (usually a mixture in an amount of 40 wt % or less, preferably from 10 to 25 wt % based on the solvent) having an appropriate concentration is heated in an appropriate solvent (e.g., ethanol, methanol, water) in the presence of a polymerization initiator (e.g., benzoyl peroxide, azobisisobutyronitrile, ammonium persulfate) at an appropriate temperature (for example, from 40° to 120° C., preferably from 50° to 100° C.) to effect copolymerization. Thereafter, the reaction mixture is poured into a medium which does not dissolve the copolymer produced, to precipitate the product and dried to separate and remove the unreacted mixture.

The copolymer is then dissolved in a solvent which dissolves the copolymer but does not dissolve in water (e.g., ethyl acetate, butanol), and vigorously dispersed in the presence of a dispersant (e.g., surface active agent, water-soluble polymer). The solvent is distilled off and a polymer latex is obtained.

The synthesis method of the polymer latex is described in detail in U.S. Pat. Nos. 2,852,386, 2,853,457, 3,411,911, 3,411,912 and 4,197,127, Belgian Patents 688,882, 691,360 and 712,823, JP-B-45-5331, JP-A-60-18540, JP-A-51-130217, JP-A-58-137831 and JP-A-55-50240.

Any polymer latex may be preferably used if it has an average particle size of from 0.5 to 300 nm, more preferably from 30 to 250 nm.

The particle size of the polymer latex may be measured by the electron microphotography method, the soap titration method, the light scattering method or the centrifugal precipitation method, and the light scattering method is preferably used. The apparatus used in the light scattering method is DLS700 (manufactured by Otsuka Denshi KK).

The molecular weight is not particularly restricted, however, the total molecular weight is preferably from 1,000 to 1,000,000, more preferably from 2,000 to 500,000.

In the present invention, the polymer may be incorporated into the photographic constituent layer as it is or after dispersing it in water.

Specific examples of the polymer latex and the dispersant used in the synthesis thereof are set forth below. The suffix of the monomer unit indicates the content percentage of each monomer.

Lx-1 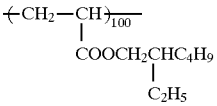

Dispersant Sf-1

Lx-2 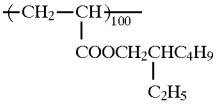

P-3

Lx-3 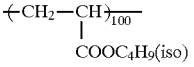

P-2

Lx-4 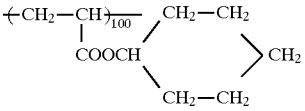

P-1

Lx-5 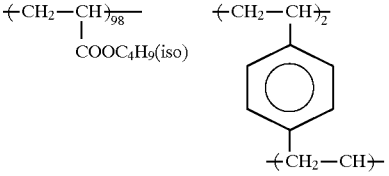

P-3

Lx-6 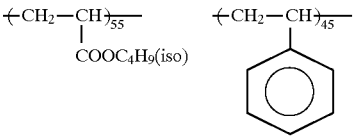

Sf-2

-continued
Lx-7 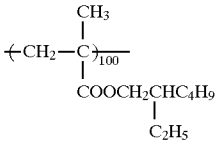
Dispersant
Dextran sulfate
Lx-8 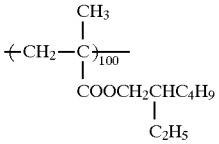
Pf-4
Lx-9 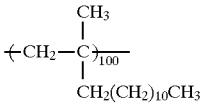
Sf-1
Lx-10 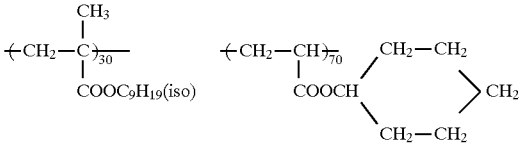
Sf-2
Lx-11 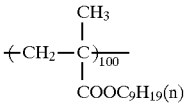
Sf-1
Lx-12 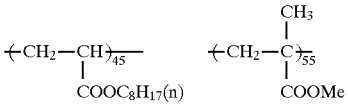
Sf-3
Lx-13 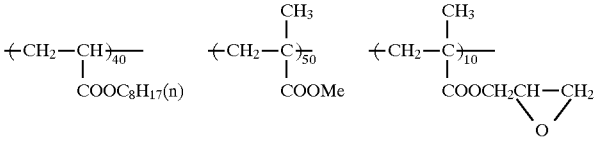
Sf-4
Lx-14 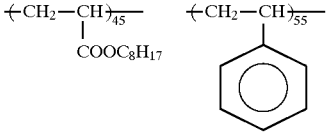
Sf-3
Lx-15 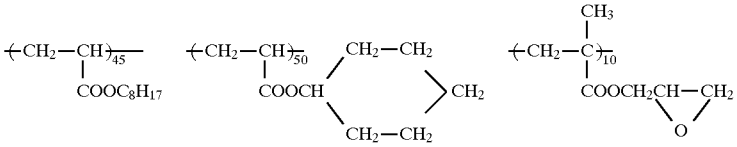
P-2
Lx-16 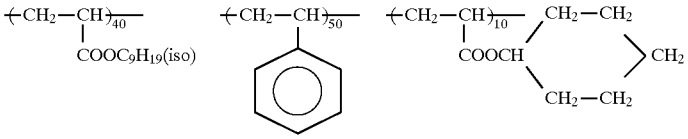
P-3
Lx-17 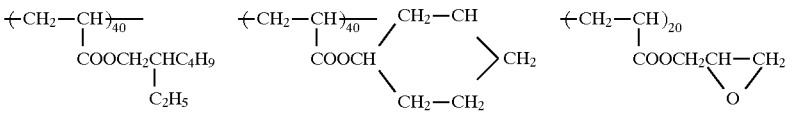
Sf-1

-continued
Lx-18 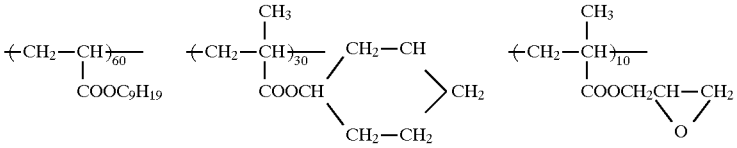 P-3
Lx-19 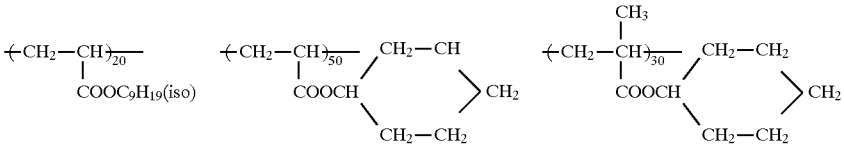 P-2 Sf-3
Lx-20 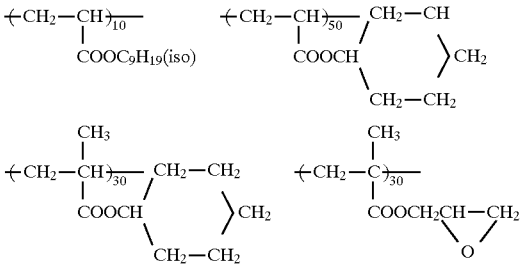 P-2 Sf-3
Lx-21 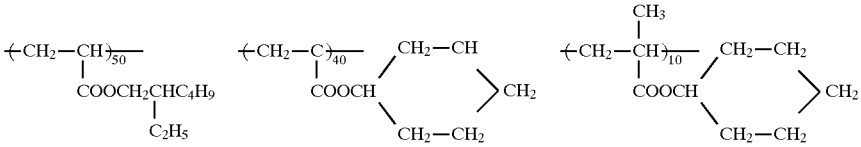 Sf-3
Sf-1 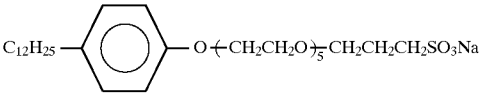
Sf-2 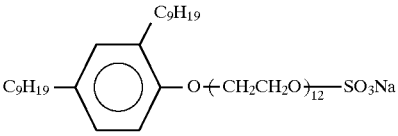
Sf-3 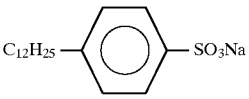
Sf-4 $C_{12}H_{25}OSO_3Na$
P-1 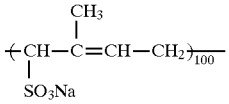 Mw = 5000
P-2 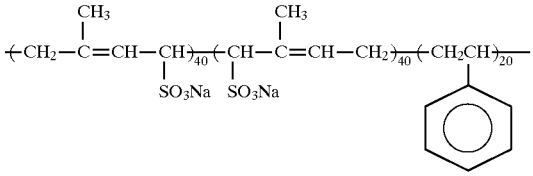 Mw = 40000
P-3 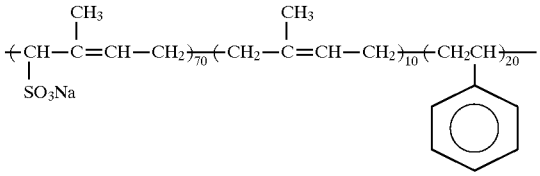 Mw = 40000

-continued

P-4 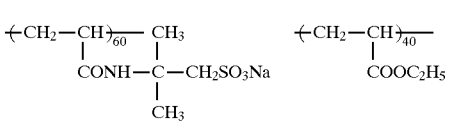

Mw = 150,000

The polymer latex may be added to any layer of the silver halide photographic light-sensitive material of the present invention. The polymer latex may be added to only one layer of the silver halide emulsion layer and other hydrophilic colloid layers, however, it is preferably added to both of the layers, more preferably to both a silver halide emulsion layer and a hydrophilic colloid layer farthest from the support.

In order to extract the effect of the present invention more effectively, the polymer latex is most preferably added to an emulsion layer and a protective layer as the uppermost layer.

The polymer latex is preferably added in an amount of from 5 to 70 wt % based on the amount of binder in the photographic constituent layers. If the addition amount is less than this range, the effect of the present invention is scarcely obtained, whereas it is too much large, the photographic capability may be deteriorated. In the case of adding the polymer latex to both an emulsion layer and a protective layer, the weight ratio of the addition amount in the protective layer to the addition amount in the emulsion layer is preferably from 0.3 to 0.4.

The silver halide photographic light-sensitive material of the present invention preferably contains colloidal silica in the light-sensitive silver halide emulsion layer.

The colloidal silica preferably has an average particle size of 0.1 $\mu$m or less, more preferably from 0.005 to 0.08 $\mu$m.

The colloidal silica comprises silicon dioxide as the main component and may contain an aluminate as a modicum component. Examples of the aluminate include sodium aluminate and potassium aluminate.

The colloidal silica may contain, as a stabilizer, an inorganic acid such as sodium hydroxide, potassium hydroxide, lithium hydroxide or ammonium hydroxide, or an organic salt such as tetramethylammonium ion.

Specific examples of the colloidal silica include commercially available products under the trade names of Ludox AM, Ludox AS, Ludox LS, Ludox TM and Ludox HS (all produced by E.I. Du Pont de Nomours & Co, USA), under the trade names of Snowtex 20, Snowtex 30, Snowtex C and Snowtex 0 (all produced by Nissan Chemical KK), under the trade names of Syton C-30 and Syton Z00 (both produced by Monsanto Co, USA), and under the trade names of Nalcoag-1060 and Nalcoag-ID 21 to 64 (all produced by Nalco Chem Co.), and these are easily available.

The colloidal silica added to the emulsion of the present invention is used in an amount of from 0.05 to 1.5 g/m$^2$, more preferably from 0.1 to 1.0 g/m$^2$. In the addition, the colloidal silica may be appropriately diluted with water or a hydrophilic solvent, and the time for the addition to the emulsion is not particularly limited, however, the colloidal silica is preferably added at any stage between after the completion of chemical ripening and before the coating.

The amount of silver halide used in the silver halide photographic light-sensitive material is not particularly specified, however, it is preferably, in terms of silver amount per one surface, from 1.0 to 5.0 g/m$^2$, more preferably from 1.0 to 3.5 g/m$^2$.

The amount of silver to the gelatin binder is also not particularly specified, however, according to the purpose, the silver is preferably used at a silver (by weight)/gelatin (by weight) ratio of from 0.01 to 5.0.

In the case when the silver halide photographic light-sensitive material has a plurality of silver halide emulsion layers, the plural silver halide emulsion layers may be provided on one side of the support or may be provided on both sides of the support. The colloidal silica may be incorporated into all of the plural silver halide emulsion layers or a part of the silver halide emulsion layers. In the case when the colloidal silica is incorporated into a part of the silver halide emulsion layers, it is preferably incorporated into the silver halide emulsion layer farthest from the support.

The silver halide photographic light-sensitive material of the present invention may preferably contains a polyhydric alcohol in the silver halide emulsion layer in an amount of from $1.0\times10^{-3}$ to $5.0\times10^{-1}$ mol per mol of silver halide.

The polyhydric alcohol is preferably added in an amount of from $5.0\times10^{-2}$ to $2.0\times10^{-1}$ mol per mol of silver halide.

The polyhydric alcohol for use in the present invention is preferably an alcohol having from 2 to 12 hydroxyl groups in the molecule and from 2 to 20 carbon atoms, in which the hydroxyl group and the hydroxyl group are not conjugated through a conjugation chain, namely, an alcohol incapable of writing the oxidized form. Further, an alcohol having a melting point of from 50° to 300° C. is preferred.

Specific examples of the polyhydric alcohol which can be preferably used are set forth below, however, the present invention is by no means limited thereto.

| No. | Name of Compound | Melting Point (°C.) |
|---|---|---|
| 1. | 2,3,3,4-Tetramethyl-2,4-pentanediol | 76 |
| 2. | 2,2-Dimethyl-1,3-propanediol | 127–128 |
| 3. | 2,2-Diinethyl-1,3-pentanediol | 60–63 |
| 4. | 2,2,4-Trimethyl-1,3-diol | 52 |
| 5. | 2,5-Hexanediol | 43–44 |
| 6. | 2,5-Dimethyl-2,5-hexanediol | 92–93 |
| 7. | 1,6-Hexanediol | 42 |
| 8. | 1,8-Octanediol | 60 |
| 9. | 1,9-Nonanediol | 45 |
| 10. | 1,10-Decanediol | 72–74 |
| 11. | 1,11-Undecanediol | 62 |
| 12. | 1,12-Dodecanediol | 79 |
| 13. | 1,13-Tridecanediol | 77 |
| 14. | 1,14-Tetradecanediol | 83–85 |
| 15. | 1,12-Octadecanediol | 66–67 |
| 16. | 1,18-Octadecanediol | 96–98 |
| 17. | Cis-2,5-dimethylhexene-2,5-diol | 69 |
| 18. | Trans-2,5-dimethyl-3-hexene-2,5-diol | 77 |
| 19. | 2-Butene-1,4-diol | 55 |
| 20. | 2,5-Dimethyl-3-hexine-2,5-diol | 95 |
| 21. | 2,4-Hexadiine-1,6-diol | 111–112 |
| 22. | 2,6-octadiine-1,8-diol | 89 |
| 23. | 2-Methyl-2,3,4-butanetriol | 49 |
| 24. | 2,3,4-Hexanetriol | 47 |
| 25. | 2,4-Dimethyl-2,3,4-hexanetriol | 99 |
| 26. | 2,4-Dimethyl-2,3,4-pentanetriol | 75 |
| 27. | Pentamethyl glycerin | 116–117 |
| 28. | 2-Methyl-2-oxymethyl-1,3-propanediol | 199 |
| 29. | 2-Isopropyl-2-oxymethyl-1,3-propanediol | 83 |
| 30. | 2,2-Dihydroxymethyl-1-butanol | 58 |
| 31. | Erythritol | 126 |
| 32. | D-Threitol | 88 |
| 33. | L-Threitol | 88 |
| 34. | rac-Threitol | 72 |
| 35. | Pentaerythritol | 260–265 |

-continued

| No. | Name of Compound | Melting Point (°C.) |
|---|---|---|
| 36. | 1,2,3,4-Pentatetrol | 106 |
| 37. | 2,3,4,5-Hexanetetrol | 162 |
| 38. | 2,5-Dimethyl-2,3,4,5-hexanetetrol | 153–154 |
| 39. | 1,2,5,6-Hexanetetrol | 95 |
| 40. | 1,3,4,5-Hexanetetrol | 88 |
| 41. | 1,6-(Erythro-3,4)-hexanetetrol | 121–122 |
| 42. | 3-Hexene-1,2,5,6-tetrol | 80–82 |
| 43. | 3-Hexine-1,2,5,6-tetrol | 113–115 |
| 44. | Adonitol | 102 |
| 45. | D-Arabitol | 102 |
| 46. | L-Arabitol | 102 |
| 47. | rac-Arabitol | 105 |
| 48. | Xylitol | 93–95 |
| 49. | L-Mannitol | 164 |
| 50. | Dulcitol | 189 |

In the present invention, the polyhydric alcohol is preferably added in an amount of from 1 to 100 g per mol of silver halide. The polyhydric alcohol is preferably added to a silver halide emulsion layer or a layer adjacent thereto.

The black-and-white photographic light-sensitive material prepared according to the present invention may contain a water-soluble dye as a filter dye in a hydrophilic colloidal layer or for other various purposes such as prevention of irradiation. Examples of such a dye include an oxonol dye, a hemioxonol dye, a styryl dye, a merocyanine dye, a cyanine dye and an azo dye. Among these, an oxonol dye, a hemioxonol dye and a merocyanine dye are useful.

The light-sensitive material of the present invention may preferably used a solid dispersion of the following dye:

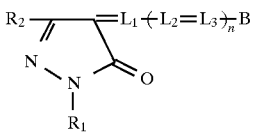

(I)

wherein $R_1$ represents a hydrogen atom, an alkyl group, an aryl group or a heterocyclic group, $R_2$ represents a hydrogen atom, an alkyl group, an aryl group, a heterocyclic group, an alkoxycarbonyl group, an aryloxycarbonyl group, a carbamoyl group, an acylamino group, a ureido group, an amino group, an acyl group, an alkoxy group, an aryloxy group, a hydroxy group, a carboxy group, a cyano group, a sulfamoyl group or a sulfonamido group, B represents a 5- or 6-membered oxygen-containing heterocyclic group or a 6-membered nitrogen-containing heterocyclic group, $L_1$ to $L_3$ each represents a methine group, and n represents 0, 1 or 2.

The compound represented by formula (I) has at least one of a carboxy group, a sulfonamido group and a sulfamoyl group.

The compound represented by formula (I) is described below. Examples of the alkyl group represented by $R_1$ or $R_2$ in formula (I) include a methyl group, an ethyl group, an n-propyl group, an iso-propyl group, a t-butyl group, an n-pentyl group, an n-hexyl group, an n-octyl group, a 2-ethylhexyl group, an n-dodecyl group, an n-pentadecyl group and an eicosyl group. The alkyl group may have a substituent and examples of the substituent include a halogen atom (e.g., chlorine, bromine, iodine, fluorine), an aryl group (e.g., phenyl, naphthyl), a cycloalkyl group (e.g., cyclopentyl, cyclohexyl), a heterocyclic group (e.g., pyrrolidyl, pyridyl, furyl, ethienyl), a sulfinic acid group, a carboxyl group, a nitro group, a hydroxyl group, a mercapto group, an amino group (e.g., amino, diethylamino), an alkyloxy group (e.g., methyloxy, ethyloxy, n-butyloxy, n-octyloxy, isopropyloxy), an aryloxy group (e.g., phenyloxy, naphthyloxy), a carbamoyl group (e.g., aminocarbonyl, methylcarbamoyl, n-pentylcarbamoyl, phenylcarbamoyl), an amido group (e.g., methylamido, benzamido, n-octylamido), an aminosulfonylamino group (e.g., aminosulfonylamino, methylaminosulfonylamino, anilinosulfonylamino), a sulfamoyl group (e.g., sulfamoyl, methylsulfamoyl, phenylsulfamoyl, n-butylsulfamoyl), a sulfonamido group (e.g., methanesulfonamido, n-heptanesulfonamido, benzenesulfonamido), a sulfinyl group (including an alkylsulfinyl group such as methylsulfinyl, ethylsulfinyl, phenylsulfinyl and octylsulfinyl, and an arylsulfinyl group such as phenylsulfinyl), an alkyloxycarbonyl group (e.g., methyloxycarbonyl, ethyloxycarbonyl, 2-hydroxyethyloxycarbonyl, n-octyloxycarbonyl), an aryloxycarbonyl group (e.g., phenyloxycarbonyl, naphthyloxycarbonyl), an alkylthio group (e.g., methylthio, ethylthio, n-hexylthio), an arylthio group (e.g., phenylthio, naphthylthio), an alkylcarbonyl group (e.g., acetyl, ethylcarbonyl, n-butylcarbonyl, n-octylcarbonyl), an arylcarbonyl group (e.g., benzoyl, p-methanesulfonamidobenzoyl, p-carboxybenzoyl, naphthoyl), a cyano group, a ureido group (e.g., methylureido, phenylureido) and a thioureido group (e.g., methylthioureido, phenylthioureido).

Examples of the aryl group represented by $R_1$ or $R_2$ includes a phenyl group and a naphthyl group. The aryl group may have a substituent and examples of the substituent include the above-described alkyl groups and groups described as the substituent of the alkyl group.

Examples of the heterocyclic group represented by $R_1$ or $R_2$ include a pyridyl group (e.g., 2-pyridyl, 3-pyridyl, 4-pyridyl, 5-carboxy-2-pyridyl, 3,5-dichloro-2-pyridyl, 4,6-dimethyl-2-pyridyl, 6-hydroxy-2-pyridyl, 2,3,5,6-tetrafluoro-4-pyridyl, 3-nitro-2-pyridyl), an oxazolyl group (e.g., 5-carboxyl-2-benzoxazolyl, 2-benzoxazolyl, 2-oxazolyl), a thiazolyl group (e.g., 5-sulfamoyl-2-benzothiazolyl, 2-benzothiazolyl, 2-thiazolyl), an imidazolyl group (e.g., 1-methyl-2-imidazolyl, 1-methyl-5-carboxy-2-benzimidazolyl), a furyl group (e.g., 3-furyl), a pyrrolyl group (e.g., 3-pyrrolyl), a thienyl group (e.g., 2-thienyl), a pyrazinyl group (e.g., 2-pyrazinyl), a pyrimidinyl group (e.g., 2-pyrimidinyl, 4-chloro-2-pyrimidinyl), a pyridazinyl group (e.g., 2-pyridazinyl), a purinyl group (e.g., 8-purinyl), an isooxazolyl group (e.g., 3-isooxazolyl), a selenazolyl group (e.g., 5-carboxy-2-selenazolyl), a sulforanyl group (e.g., 3-sulforanyl), a piperidinyl group (e.g., 1-methyl-3-piperidinyl), a pyrazolyl group (e.g., 3-pyrazolyl) and a tetrazolyl group (e.g., 1-methyl-5-tetrazolyl). The heterocyclic group may have a substituent and examples of the substituent include the above-described alkyl groups and the groups described as the substituent of the alkyl group.

Examples of the alkoxycarbonyl group represented by $R_2$ include a methoxycarbonyl group, an ethoxycarbonyl group, an i-propoxycarbonyl group, a t-butoxycarbonyl group, a pentyloxycarbonyl group and a dodecyloxycarbonyl group.

Examples of the aryloxycarbonyl group represented by $R_2$ include a phenoxyoxycarbonyl group and a naphthyloxycabonyl group.

Examples of the carbamoyl group represented by $R_2$ include an aminocarbonyl group, a methylcarbamoyl group, an ethylcarbamoyl group, an i-propylcarbamoyl group, a t-butylcarbamoyl group, a dodecylcarbamoyl group, a phenylcarbamoyl group, a 2-pyridylcarbamoyl group, a 4-pyridylcarbamoyl group, a benzylcarbamoyl group, a morpholinocarbamoyl group and a piperazinocarbamoyl group.

Examples of the acylamino group represented by $R_2$ include a methylcarbonylamino group, an ethylcarbonylamino group, a i-propylcarbonylamino group, a t-butylcarbonylamino group, a dodecylcarbonylamino group, a phenylcarbonylamino group and a naphthylcarbonylamino group.

Examples of the ureido group represented by $R_2$ include a methylureido group, an ethylureido group, an i-propylureido group, a t-butylureido group, a dodecylureido group, a phenylureido group, a 2-pyridylureido group and a thiazolylureido group.

Examples of the amino group represented by $R_2$ include an amino group, a methylamino group, an ethylamino group, an i-propylamino group, a t-butylamino group, an octylamino group, a dodecylamino group, a dimethylamino group, an anilino group, a naphthylamino group, a morpholino group and a piperazino group.

Examples of the acyl group represented by $R_2$ include a methylcarbonyl group, an ethylcarbonyl group, an i-propylcarbonyl group, a t-butylcarbonyl group, an octylcarbonyl group, a dodecylcarbonyl group, a phenylcarbonyl group and a naphthylcarbonyl group.

Examples of the alkoxy group represented by $R_2$ include a methoxy group, an ethoxy group, an i-propoxy group, a t-butyloxy group and a dodecyloxy group.

Examples of the aryloxy group represented by $R_2$ include a phenoxy group and a naphthyloxy group.

Examples of the sulfamoyl group represented by $R_2$ include an aminosulfonyl group, a methylsulfamoyl group, an i-propylsulfamoyl group, a t-butylsulfamoyl group, a dodecylsulfamoyl group, a phenylsulfamoyl group, a 2-pyridylsulfamoyl group, a 4-pyridylsulfamoyl group, a morpholinosulfamoyl group and a piperazinosulfamoyl group.

Examples of the sulfonamido group represented by $R_2$ include a methylsulfonamido group, an ethylsulfonamido group, an i-propylsulfonamido group, a t-butylsulfonamido group, a dodecylsulfonamido group, a phenylsulfonamido group and a naphthylsulfonamido group.

These groups each may have a substituent and examples of the substituent include the alkyl groups described above for $R_1$ and $R_2$ and the groups described as the substituent of the alkyl group for $R_1$ and $R_2$.

Examples of the 5- or 6-membered oxygen-containing heterocyclic group and the 6-membered nitrogen-containing heterocyclic group represented by B in formula (I) include a furyl group (e.g., 2-furyl, 3-furyl, 2-benzofuranyl, 3-benzofuranyl, 1-isobenzofuranyl), a pyranyl group (e.g., 2-tetrahydropyranyl, 3-2H-pyranyl, 4-2H-pyranyl, 5-2H-pyranyl, 6-2H-pyranyl, 2-4H-pyranyl, 3-4H-pyranyl, 2-chromanyl, 3-chromanyl, 4-2H-chromenyl, 2-4H-chromenyl), a pyronyl group (e.g., 2-4H-pyronyl, 3-4H-pyronyl, 2-chromonyl, 3-choumarinyl, 3-chromonyl), a pyridyl group (e.g., 2-pyridyl, 3-pyridyl, 4-pyridyl, 2-quinolyl, 3-quinolyl, 4-quinolyl, 9-acridinyl, 3-thienopyridyl), a pyrazinyl group (e.g., 2-pyrazinyl), a pyrimidinyl group (e.g., 2-pyrimidinyl, 4-pyrimidinyl, 5-pyrimidinyl, 2-quinazolinyl) and a piperidinyl group (e.g., 3-piperidinyl). The heterocyclic group may have a substituent and examples of the substituent include the alkyl groups and the groups described above as the substituent of the alkyl group for $R_1$ and $R_2$, and further include the groups described above as the amino group, the alkoxy group and the aryloxy group for $R_2$.

The methine group represented by $L_1$, $L_2$ or $L_3$ in formula (I) may have a substituent and examples of the substituent include an alkyl group (e.g., methyl, ethyl, isopropyl, t-butyl, 3-hydroxypropyl, benzyl), an aryl group (e.g., phenyl), a halogen atom (e.g., chlorine, bromine, iodine, fluorine), an alkoxy group (e.g., methoxy, ethoxy) and an acyloxy group (e.g., methylcarbonyloxy, phenylcarbonyloxy).

Specific examples of the compound of the present invention are set forth below, however, the present invention is by no means limited thereto.

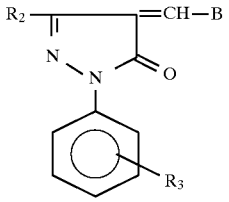

| Compound No. | $R_2$ | $R_3$ | B |
|---|---|---|---|
| 1-1 | $-CH_3$ | 4-COOH | 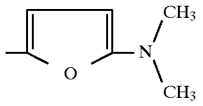 |
| 1-2 | $-COOC_2H_5$ | 4-COOH | 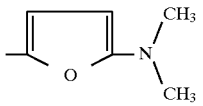 |
| 1-3 | $-CONH_2$ | 4-COOH | 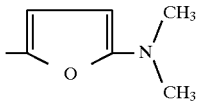 |
| 1-4 | $-COCH_3$ | 4-COOH | 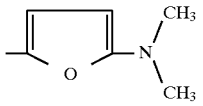 |

-continued
| | | | |
|---|---|---|---|
| 1-5 | $-CN$ | 4-COOH | 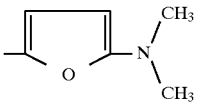 |
| 1-6 | $-CONH_2$ | 4-$SO_2NH_2$ | 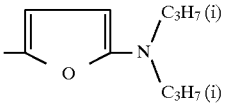 |
| 1-7 | 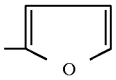 | 2-COOH, 5-COOH | 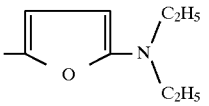 |
| 1-8 | $-OC_2H_5$ | 3-COOH | 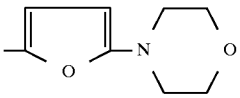 |
| 1-9 | $-COCH_3$ | 2-COOH | 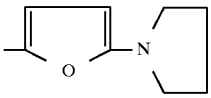 |
| 1-10 | $-COOC_2H_5$ | 4-$NHSO_2CH_3$ | 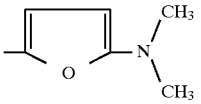 |
| 1-11 | $-COOH$ | 4-$NHSO_2CH_3$ | 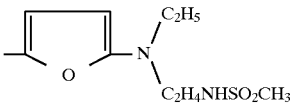 |
| 1-12 | $-CONH_2$ | 2-COOH, 5-COOH | 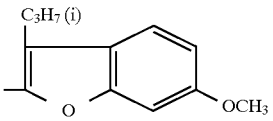 |
| 1-13 | $-COCH_3$ | 3-COOH | 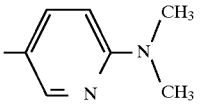 |
| 1-14 | $-COCH_3$ | 4-COOH | 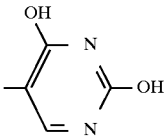 |
| 1-15 | $-COC_2H_5$ | 4-COOH | 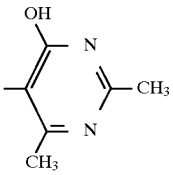 |
| 1-16 | $-COOCH_3$ | 4-COOH | 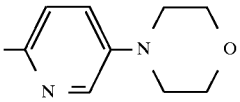 |

-continued

| | | | |
|---|---|---|---|
| 1-17 | $-COCH_3$ | 2-COOH, 5-COOH | 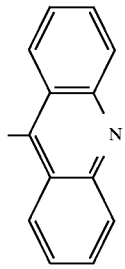 |
| 1-18 | $-COOH$ | H | 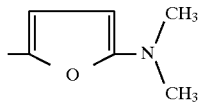 |

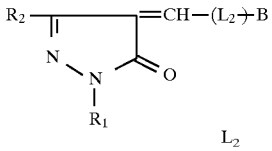

| Compound No. | $R_2$ | $R_1$ | $L_2$ | B |
|---|---|---|---|---|
| 1-19 | $-COOC_2H_5$ | 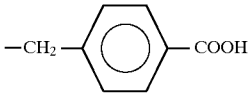 | — | 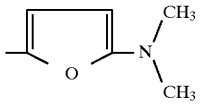 |
| 1-20 | 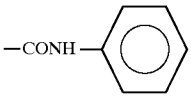 | $-CH_2COOH$ | — | 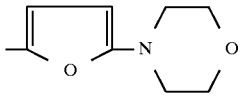 |
| 1-21 | $-COOH$ | $-CH_3$ | — | 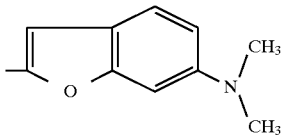 |
| 1-22 | $-NHCONHCH_3$ | $-CH_2COOH$ | $-CH=CH-$ | 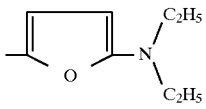 |

In the present invention, a light-sensitive silver halide emulsion layer and a hydrophilic colloid layer other than the surface protective layer preferably contain a dye represented by formula (II), which is non-dissolving (i.e., is substantially not removed from a photographic material by a processing solution) and in the solid fine dispersion state:

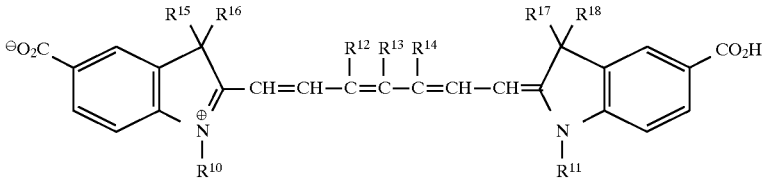

(II)

wherein $R^{10}$ and $R^{11}$ each represents an alkyl group, an aralkyl group or an alkenyl group, $R^{2}$and $R^{14}$ each represents a hydrogen atom or an atomic group necessary for forming a 5- or 6-membered ring by combining with each other, $R^{13}$ represents an aryl group, $—N(R^{19})(R^{20})$, $—SR^{21}$ or $—OR^{22}$ (wherein $R^{19}$ represents a hydrogen atom, an alkyl group or an aryl group, $R^{20}$ represents an aryl group, a sulfonyl group or an acyl group, $R^{19}$ and $R^{20}$ may be combined with each other to form a ring, and $R^{21}$ and $R^{22}$ each represents an aryl group), $R^{15}$, $R^{16}$, $R^{17}$ and $R^{18}$ each represents an alkyl group, and $R^{15}$ and $R^{16}$ or $R^{17}$ and $R^{18}$ may be combined to form a ring.

Formula (II) is further described below.

The alkyl group represented by $R^{10}$, $R^{11}$, $R^{15}$, $R^{16}$, $R^{17}$, $R^{18}$ or $R^{19}$ is an unsubstituted alkyl group having from 1 to 10, preferably from 1 to 6 carbon atoms (e.g., methyl, ethyl, propyl, butyl, isobutyl, pentyl, hexyl). $R^{15}$ and $R^{16}$ or $R^{17}$ and $R^{18}$ may be combined with each other to form a ring (e.g., cyclohexane).

The alkenyl group and the aralkyl group represented by $R^{10}$ or $R^{11}$ are preferably an aralkyl group having from 7 to 12 carbon atoms and may have a substituent (e.g., methyl, carboxy, alkoxy, chlorine atom).

The aryl group represented by $R^{13}$, $R^{19}$, $R^{20}$, $R^{21}$ or $R^{22}$ is preferably —$N(R^6)(R^7)$, $SR^8$ or —$OR^9$, more preferably —$N(R^6)(R^7)$.

$R^6$ is preferably an alkyl group or an aryl group, more preferably an aryl group.

In —$N(R^6)(R^7)$, preferably one of $R^6$ and $R^7$ is an aryl group, more preferably $R^6$ and $R^7$ both are an aryl group. $R^6$ and R7 each is most preferably a phenyl group.

The aryl group represented by $R^6$ or $R^7$ is preferably an aryl group having from 6 to 12 carbon atoms and examples thereof include a phenyl group and a naphthyl group. The aryl group may be substituted and the substituent may be any if it is a group which does not dissolve the dye during the development processing. Examples of the substituent include a methyl group, an ethyl group, a chlorine atom, a methoxy group and a methoxycarbonyl group.

The sulfonyl group represented by $R^7$ is preferably an alkyl- or arylsulfonyl group having from 1 to 10 carbon atoms, and examples thereof include a mesyl group, a tosyl group, a benzenesulfonyl group and an ethanesulfonyl group.

The acyl group represented by $R^7$ is preferably an alkyl- or arylacyl group having from 2 to 10 carbon atoms, and examples thereof include an acetyl group, a propionyl group and a benzoyl group.

$R^6$ and $R^7$ may be combined with each other to form a 5- or 6-membered ring, and examples of the ring include piperidine, morpholine and piperazine. These rings each may have a substituent (e.g., methyl, phenyl, ethoxycarbonyl).

The sulfonyl group or the acyl group represented by $R^{20}$ has the same meaning as the sulfonyl group or the acyl group for $R^7$.

Examples of the halogen atom represented by $R^3$ includes F, Cl and Br. The ring formation by $R^{19}$ and $R^{20}$ has the same meaning as the ring formation by $R^6$ and $R^7$.

$R^{10}$ and $R^{11}$ each is preferably an alkyl group.

$R^{12}$ and $R^{14}$ are preferably combined to form a 5- or 6-membered ring.

$R^{13}$ is preferably —$N(R^{19})(R^{20})$ —$SR^{21}$ or —$OR^{22}$, more preferably —$N(R^{19})(R^{20})$.

$R^{19}$ is preferably an alkyl group or an aryl group.

In —$N(R^{19})(R^{20})$ for $R^{13}$, preferably one of $R^{19}$ and $R^{20}$ is an aryl group, more preferably $R^{19}$ and $R^{20}$ both are an aryl group. $R^{19}$ and $R^{20}$ each is most preferably a phenyl group.

The combination is preferably such that $R^{10}$ and $R^{11}$ each is an alkyl group and $R^{13}$ is —$N(R^{19})(R^{20})$ —$SR^{21}$ or —$OR^{21}$, more preferably $R^{12}$ and $R^{14}$ are combined to form a 5- or 6-membered ring and $R^{13}$ is —$N(R^{19})(R^{20})$, still more preferably one of $R^{19}$ and $R^{20}$ is an aryl group, and most preferably $R^{19}$ and $R^{20}$ both are an aryl group.

Specific examples of the dye for use in the silver halide light-sensitive material of the present invention are set forth below, but the present invention is by no means limited thereto.

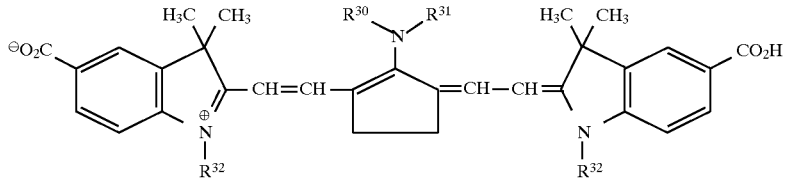

| Compound | $R^{30}$ | $R^{31}$ | $R^{32}$ |
|---|---|---|---|
| 1 | 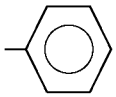 | 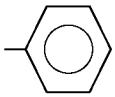 | $CH_3$ |
| 2 | 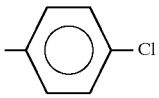 | 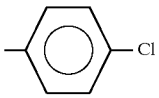 | $CH_3$ |
| 3 | 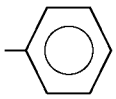 | $CH_3$ | $CH_3$ |
| 4 | 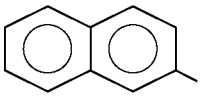 | $C_2H_5$ | $C_2H_5$ |

-continued
| | | | |
|---|---|---|---|
| 5 | $CH_3$ | 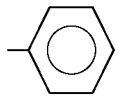 | n-$C_4H_9$ |
| 6 | 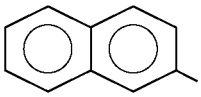 | 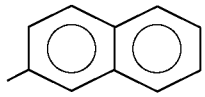 | $CH_3$ |
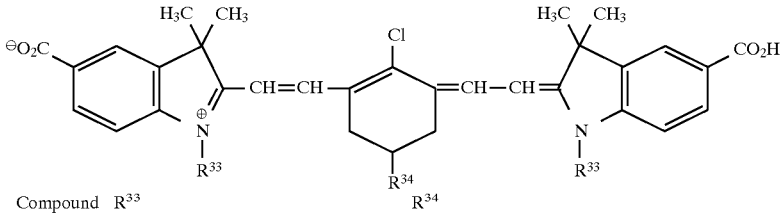
| Compound | $R^{33}$ | $R^{34}$ |
|---|---|---|
| 7 | n-$C_4H_9$ | $CH_3$ |
| 8 | " | t-$C_4H_9$ |
| 9 | " | 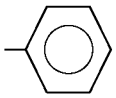 |
| 10 | $C_3H_7$ | 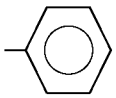 |
| 11 | n-$C_6H_{13}$ | t-$C_4H_9$ |
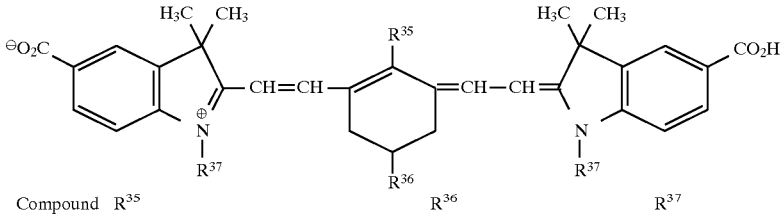
| Compound | $R^{35}$ | $R^{36}$ | $R^{37}$ |
|---|---|---|---|
| 12 | 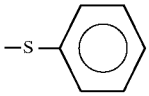 | $CH_3$ | $CH_3$ |
| 13 | " | t-$C_4H_9$ | " |
| 14 | 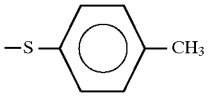 | 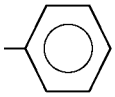 | " |
| 15 | 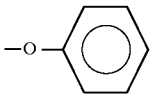 | t-$C_4H_9$ | " |
| 16 | 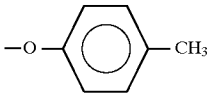 | 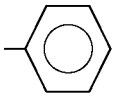 | " |
| 17 | 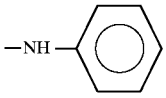 | t-$C_4H_9$ | " |

-continued
| | | | |
|---|---|---|---|
| 18 | 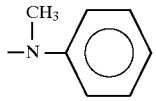 | " | " |
| 19 | 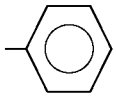 | H | $C_4H_9$ |
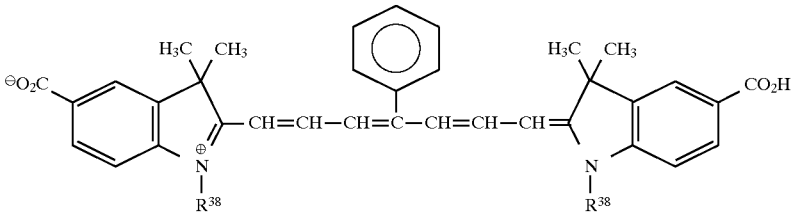
| Compound | $R^{38}$ |
|---|---|
| 20 | $CH_3$ |
| 21 | $C_2H_5$ |
| 22 | n-$C_3H_7$ |
| 23 | n-$C_4H_9$ |
| 24 | n-$C_5H_{11}$ |
| 25 | n-$C_6H_{13}$ |
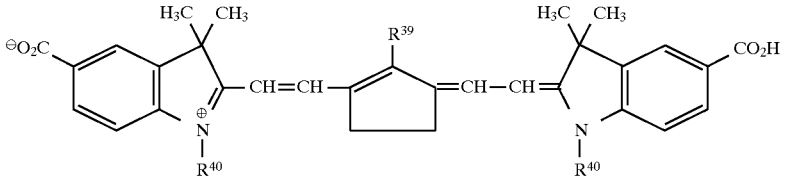
| Compound | $R^{39}$ | $R^{40}$ |
|---|---|---|
| 26 | 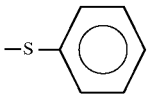 | n-$C_4H_9$ |
| 27 | 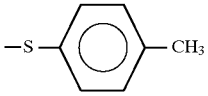 | " |
| 28 | 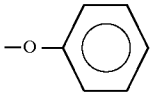 | " |
| 29 | 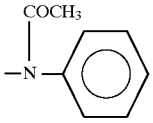 | $CH_3$ |
| 30 | 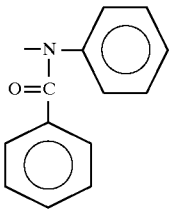 | $CH_3$ |

-continued
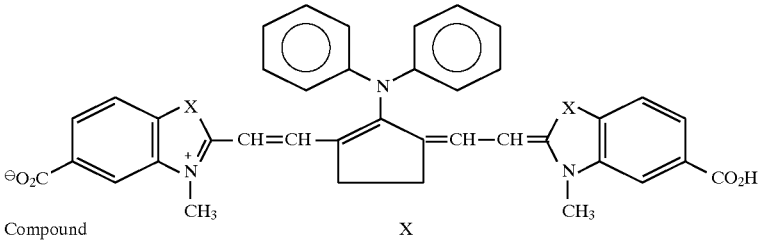
| Compound | X |
|---|---|
| 31 | O |
| 32 | S |
| 33 | N-$CH_3$ |
Compound 34
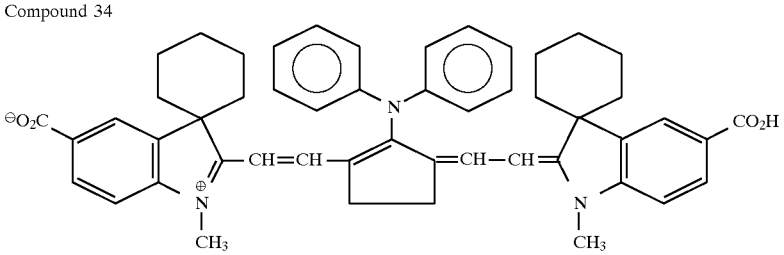
Compound 35
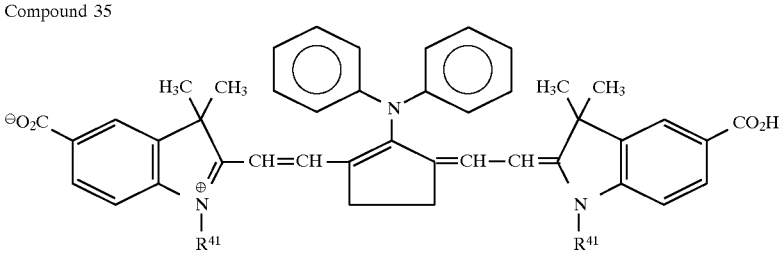
$R^{41}$ = —$CH_2$—CH═$CH_2$
Compound 36
$R^{41}$ = —$CH_2$—
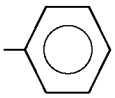
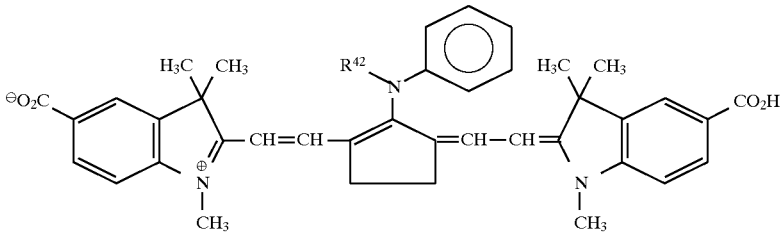
Compound 37 $R^{42}$ = —$SO_2CH_3$
Compound 38
$R^{42}$ = —$SO_2$—
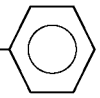
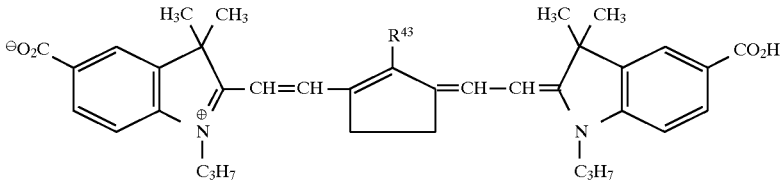

-continued

| Compound | $R^{43}$ |
|---|---|
| 39 | 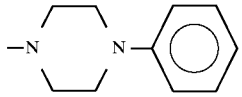 |
| 40 | 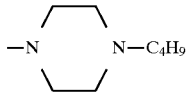 |
| 41 | 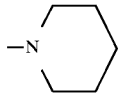 |
| 42 | Cl |

The dye represented by formula (II) can be synthesized by referring to U.S. Pat. Nos. 3,671,648 and 2,095,854, JP-A-6-43583 and the following synthesis example.

(Synthesis of Compound 1)

9.8 g of 1,2,3,3-tetramethyl-5-carboxyindolenium p-toluenesulfonate, 6 g of 1-[2,5-bis(anilinomethylene)-cyclopentylidene]-diphenylanilinium tetrafluoroborate, 100 ml of ethyl alcohol, 5 ml of acetic anhydride and 10 ml of triethylamine were stirred at an outer temperature of 100° C. for 1 hour, and the crystals deposited were separated by filtration. The crystals obtained were recrystallized from 100 ml of methyl alcohol to obtain 7.3 g of Compound 1.

Melting point: 270° C. or higher, Amax: 809.1 nm, $\epsilon$: $1.57\times10^5$ (dimethyl sulfoxide).

Other compounds may be synthesized in the same manner.

The dye for use in the silver halide light-sensitive material of the present invention is preferably non-dissolving, in other words, a dye substantially free of spectral change between before and after the development is preferred. The term "non-dissolving" as used in the present invention means that when the dyes are immersed in $H_2O$ at 25° C. for 30 seconds, 97% or more remain in the light-sensitive material.

The dye for use in the silver halide light-sensitive material of the present invention has a $\lambda$max in the light-sensitive material of from about 700 to 1,100 nm, preferably from 800 to 1,000 nm, more preferably from 850 to 950 nm, and exhibits little absorption in the visible region, and even if it absorbs, no harmful effect comes out on the photographic property.

The dye for use in the silver halide light-sensitive material of the present invention is used in the solid fine particle dispersion state.

To form the dye into a solid fine particle dispersion, a dispersing machine such as a ball mill, a vibration mill, an epicyclic ball mill, a sand mill, a colloid mill, a jet mill or a roller mill described in JP-A-52-92716 and International Unexamined Patent Publication 88/074794 may be used, however, a vertical or horizontal medium dispersing machine is preferred.

In either case, a solvent (e.g., water, alcohol) may be present together. Further, a surface active agent for dispersion is preferably used. The surface active agent predominantly used is an anionic surface active agent described in JP-A-52-92716 and International Unexamined Patent Publication 88/074794. Other than that, if desired, an anionic polymer, a nonionic surface active agent or a cationic surface active agent may be used. An anionic surface active agent is preferred.

The dye for use in the silver halide light-sensitive material of the present invention may be dissolved in an appropriate solvent and formed into fine particle powder by adding thereto a bad solvent of the dye. Also in this case, the above-described surface active agent for dispersion may be used. Or, the dye may be dissolved by controlling the pH and then formed into fine crystals by varying the pH.

The finely dispersed particles of the dye in the dispersion produce have an average particle size of from 0.005 to 10 $\mu$m, preferably from 0.01 to 1 $\mu$m, more preferably from 0.01 to 0.5 $\mu$m, and in some cases, preferably from 0.01 to 0.1 $\mu$m.

The solid fine particle dispersion product of the dye for use in the silver halide light-sensitive material of the present invention is coated on use in an amount of from 0.001 to 1 g/m$^2$, preferably from 0.005 to 0.5 g/m$^2$, more preferably from 0.005 to 0.1 g/m$^2$.

The hydrophilic colloid layer to which the finely dispersed particles of the dye for use in the silver halide material of the present invention must not be either the surface protective layer (uppermost layer) or an emulsion layer. The addition of the dye to the surface protective layer (uppermost layer) is disadvantageous in that the dye transfers to the roller of an automatic transportation machine, to the roller of an automatic developing machine, or between the photographic light-sensitive materials adjacent to each other.

On the other hand, when the dye is add to a silver halide emulsion layer, the dye partly dissolved out adheres to silver halide to cause color sensitization and in many cases, the safelight property is worsened or the sensitivity in the exposure wavelength region is reduced.

The layer to which the dye for use in the silver halide light-sensitive material of the present invention is added may be a hydrophilic colloid layer such as an interlayer between the surface protective layer and an emulsion layer, an interlayer provided between a plurality of emulsion layers, a subbing layer provided between an emulsion layer and an undercoat layer of the support, or an undercoat layer itself of the support.

The dye-containing gelatin is preferably coated in an amount of from 0.02 to 1 g/m$^2$, more preferably from 0.1 to 0.6 g/m$^2$.

The optical sensor uses a light emitting diode or semiconductor laser light source emitting light in the wavelength of 700 nm or more, has a light-receiving sensitivity peak in the vicinity of 900 nm, and is combined with a light-receiving element having a sensitivity region at from about 700 to 1,200 nm. Examples of the light emitting diode include GL-514 (manufactured by Sharp KK) and TLN108 (manufactured by Toshiba KK), and examples of the light-receiving element include PT501 (manufactured by Sharp KK) and TPS601A (manufactured by Toshiba KK).

An automatic device using the above-described optical sensor is sold by respective companies.

The developing agent of the silver halide light-sensitive material of the present invention preferably used in the developer is an ascorbic acid-base developing agent or a dihydroxybenzene-base developing agent. An ascorbic acid-base developing agent is preferred.

The ascorbic acid-base developing agent is preferably the compound represented by the following formula (D):

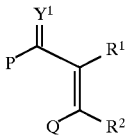

(D)

wherein $R^1$ and $R^2$ each represents a hydroxy group, an amino group, an acylamino group, an alkylsulfonylamino group, an arylsulfonylamino group, an alkoxycarbonylamino group, a mercapto group or an alkylthio group, P and Q each represents a hydroxy group, a carboxy group, an alkoxy group, an alkyl group, a sulfo group, an amino group or an aryl group, or P and Q are combined with each other to represent an atomic group for forming a 5-, 6-, 7- or 8-membered ring together with the two vinyl carbon atoms to which $R^1$ and $R^2$ substitute and the carbon atom to which $Y^1$ substitutes, and $Y^1$ represents =O or =N—$R^3$ (wherein $R^3$ represents a hydrogen atom, a hydroxy group, an alkyl group or an acyl group).

The compound represented by formula (D) is described in detail below.

In formula (D), $R^1$ and $R^2$ each represents a hydroxy group, an amino group (preferably an alkyl-substituted amino group having from 1 to 10 carbon atoms, e.g., methylamino, ethylamino, n-butylamino, hydroxyethylamino), a mercapto group, an alkylthio group (e.g., methylthio, ethylthio), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino) or an alkoxycarbonylamino group (e.g., methoxycarbonylamino). $R^1$ and $R^2$ each is preferably a hydroxy group, an amino group, an alkylsulfonylamino group or an arylsulfonylamino group.

P and Q each represents a hydroxy group, a carboxy group, an alkoxy group, an alkyl group, a sulfo group, an amino group or an aryl group, or P and Q are combined with each other to represent an atomic group for forming a 5-, 6-, 7- or 8-membered ring together with the two vinyl carbon atoms to which $R^1$ and $R^2$ substitute and the carbon atom to which $Y^1$ substitutes. The alkoxy group, the alkyl group, the amino group or the aryl group may be substituted. Specific examples of the ring structure include those constituted by combining —O—, —C($R^9$)($R^{10}$)—, —($R^{11}$)=, —C(=O)—, —N($R^{12}$)— and —N= (wherein $R^9$, $R^{10}$, $R^{11}$ and $R^{12}$ each represents a hydrogen atom, an alkyl group (which preferably has from 1 to 10 carbon atoms and may be substituted, and examples of the substituent include a hydroxy group, a carboxy group and a sulfo group), a hydroxy group or a carboxy group). The 5-, 6-, 7- or 8-membered ring may further be condensed with a saturated or unsaturated ring.

Examples of the 5- to 8-membered rings include a dihydrofuranone ring, a dihydropyrroline ring, a pyranone ring, a cyclopentenone ring, a cyclohexenone ring, a pyrrolinone ring, a pyrazolinone ring, a pyridone ring, an azacyclohexenone ring and a uracil ring, and preferred examples of the 5- to 8-membered rings include a dihydrofuranone ring, a cyclopentenone ring, a cyclohexenone ring, a pyrazolinone ring, an azacyclohexenone ring and a uracil ring.

$Y^1$ represents =O or =N—$R^3$. $R^3$ represents a hydrogen atom, a hydroxy group, an alkyl group (e.g., methyl, ethyl) or an acyl group (e.g., acetyl). The alkyl group and the acyl group each may be substituted. Examples of the substituted alkyl group include a hydroxyalkyl group (e.g., hydroxymethyl, hydroxyethyl), a sulfoalkyl group (e.g., sulfomethyl, sulfoethyl) and a carboxyalkyl group (e.g., carboxymethyl, carboxyethyl).

Specific examples of the ascorbic acid-base developing agent for use in the present invention are set forth below, however, the present invention is by no means limited thereto.

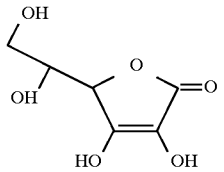

I-1

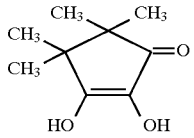

I-2

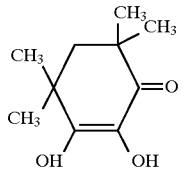

I-3

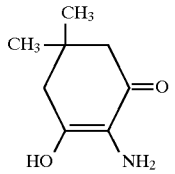

I-4

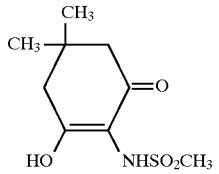

I-5

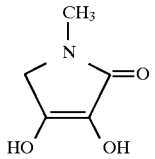

I-6

-continued
I-7
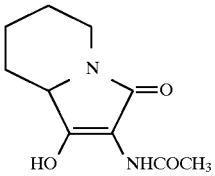
I-8
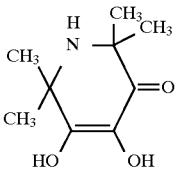
I-9
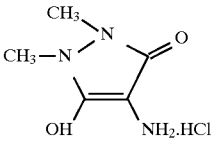
I-10
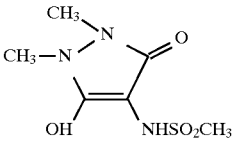
I-11
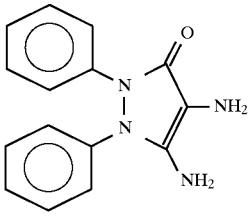
I-12
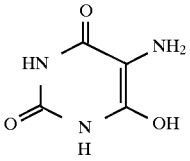
I-13
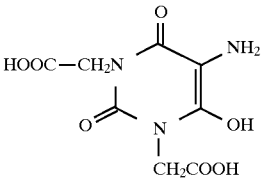
I-14
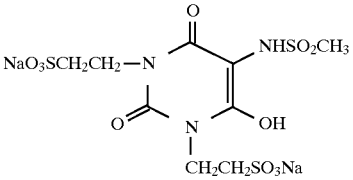
I-15
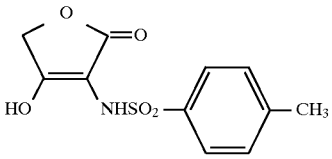
-continued
I-16
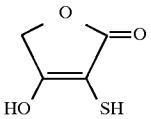
I-17
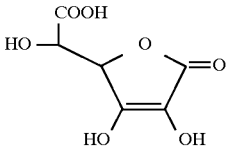
I-18
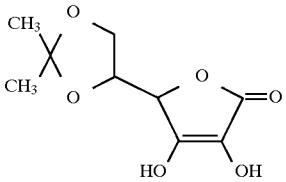
I-19
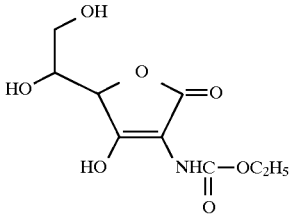
I-20
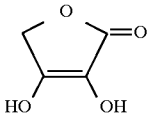
I-21
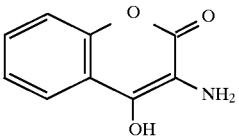
I-22
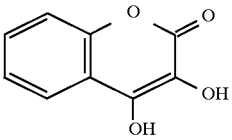
I-23
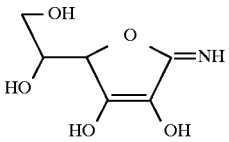
I-24
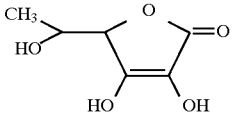
I-25
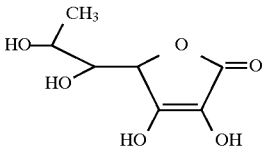

-continued

I-26

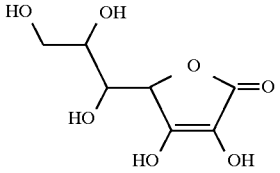

I-27

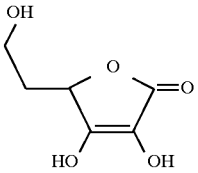

I-28

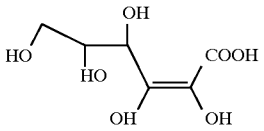

I-29

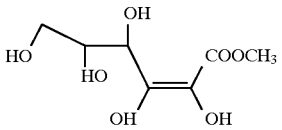

I-30

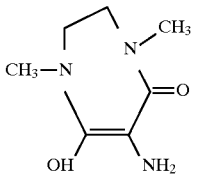

I-31

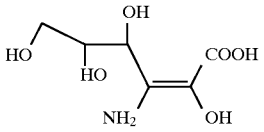

Among these, the ascorbic acid and the erythorbic acid (a diastereomer of ascorbic acid) represented by I-1, and an alkali metal salt thereof, such as lithium salt, sodium salt and potassium salt, are preferred.

Examples of the dihydroxybenzene-base developing agent include hydroquinone, hydroquinonemonosulfonic acid, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Among these, hydroquinone is preferred.

In the case of using an ascorbic acid-base developing agent, the developing agent and the developer for use in the present invention preferably contains substantially no polyhydroxybenzene compound including dihydroxybenzene such as hydroquinone. More specifically, the content of the polyhydroxybenzene compound in the developer is preferably from 0.0001 mol/l or less, and most preferably, the polyhydroxybenzene compound is not contained at all.

With respect to various additives for use in the photographic light-sensitive material of the present invention, for example, those described in the portions described below may be used.

| Item | Pertinent Portion |
|---|---|
| 1) Antifoggant, stabilizer | JP-A-2-68539, from page 10, left lower column, line 17 to page 11, left upper column, line 7, and from page 3, left lower column, line 2 to page 4, left lower column |
| 2) Tone improver | JP-A-62-276539, from page 2, left lower column, line 7 to page 10, left lower column, line 20; JP-A-3-94249, from page 6, left lower column, line 15 to page 11, right upper column, line 19 |
| 3) Spectral sensitizing dye | JP-A-2-68539, from page 4, right lower column, line 4 to page 8, right lower column |
| 4) Surface active agent, antifoggant | JP-A-2-68539, from page 11, left upper column, line 14 to page 12, left upper column, line 9 |
| 5) Matting agent, slipping agent, plasticizer | JP-A-2-68539, page 12, from left upper column, line 10 to right upper column, line 10, page 14, left lower column, line 10 to right lower column, line 1 |
| 6) Hydrophilic colloid | JP-A-2-68539, page 12, from right upper column, line 11 to left lower column, line 16 |
| 7) Hardening agent | JP-A-2-68539, from page 12, left lower column, line 17 to page 13, right upper column, line 6 |
| 8) Support | JP-A-2-68539, page 13, right upper column, lines 7 to 20 |
| 9) Cross-over cut method | JP-A-2-264944, from page 4, right upper column, line 20 to page 14, right upper column |
| 10) Dye, mordant | JP-A-2-68539, from page 13, left lower column, line 1 to page 14, left lower column, line 9; JP-A-3-24537, from page 14, left lower column to page 16, right lower column |
| 11) Polyhydroxybenzenes | JP-A-3-39948, from page 11, left upper column to page 12, left lower column; EP 452772A |
| 12) Layer structure | JP-A-3-198041 |
| 13) Development processing | JP-A-2-103037, from page 16, right upper column, line 7 to page 19, left lower column, line 15; JP-A-2-115837, from page 3, right upper column, line 5 to page 6, right upper column, line 10 |

The AgX emulsion produced by using the AgX emulsion grain and the production method of the present invention can be used in all conventional known photographic light-sensitive materials. For example, the emulsion may be used in a black-and-white silver halide photographic light-sensitive material (e.g., X-ray light-sensitive material, light-sensitive material for printing, printing paper, negative film, microfilm, direct positive light-sensitive material, ultrafine particle dry plate light-sensitive material (e.g., for LSI photomask, for shadow mask, for liquid crystal mask)) or in a color photographic light-sensitive material (e.g., negative film, printing paper, reverse film, direct positive color light-sensitive material, silver dye bleaching photograph). Further, the emulsion may be used in a diffusion transfer-type light-sensitive material (e.g., color diffusion transfer element, silver salt diffusion transfer element), a heat-developable light-sensitive material (including black-and-white material and color material), a high-density digital recording light-sensitive material or a light-sensitive material for holography.

The photographic light-sensitive material of the present invention may be preferably subjected to X-ray photographing using, for example, a phosphor described below as a fluorescent intensifying screen.

Blue light emitting phosphor:

$Y_2O_2S$:Tb, LaOBr:Tb, BaFCl:Eu

Green light emitting phosphor:

$Gd_2O_2S$:Tb, $LaO_2S$:Tb

The UV light emitting phosphor is described in detail below.

The screen having a main light emission peak at 400 nm or less may be a screen described in JP-A-6-11804 and WO93/01521, but the present invention is by no means limited thereto.

The UV light emitting phosphor for use in the present invention preferably has an emission wavelength of 400 nm or less, more preferably 370 nm or less.

Representative examples of the phosphor include M' phase $YTaO_3$ alone, a compound obtained by adding thereto Gd, Bi, Pb, Ce, Se, Al, Rb, Ca, Cr, Cd or Nb, a compound obtained by adding Gd, Tm, Gd and Tm, Gd and Ce, or Tb to LaOBr, an oxide of HfZr alone and a compound obtained by adding thereto a Ge or Ti alkali metal, $Y_2O_3$ alone and a compound obtained by adding thereto Gd or Eu, a compound obtained by adding Gd to $Y_2O_2S$, and a compound using Gd, Tl or Ce as an activating agent in the mother body of various phosphors. Among these, preferred are M' phase $YTaO_4$ alone, a compound obtained by adding thereto Gd or Sr, a compound obtained by adding Gd, Tm, or Gd and Tm to LaOBr, an oxide of HfZr and a compound obtained by adding thereto a Ge or Ti alkali metal.

The phosphor preferably has a particle size of from 1 to 20 $\mu$m, however, the particle size may be changed depending on the sensitivity required or in view of problems in production. The coating amount is preferably from 400 to 2,000 g/mm$^2$, however, it may vary depending on the sensitivity or image quality required and cannot be definitely specified. The phosphor may have a particle size distribution directing from the vicinity of the support toward the surface in one intensifying screen. In this case, it is in general known that the particle size on the surface is larger. The phosphor has a spatial filling rate of 40% or more, preferably 60% or more.

In photographing using a light-sensitive material having provided on both surfaces thereof a phosphor layer, the coating amount of the phosphor may be changed between the X-ray entering side and the side opposite thereto. In general, it is known that the X-ray entering side is shielded due to the intensifying screen and if a high-sensitive system is required, the coating amount of the intensifying screen on the X-ray entering side is reduced.

The support used in the screen for use in the present invention may be paper, metal sheet or polymer sheet, however, a flexible sheet such as polyethylene terephthalate is usually used. Even if the support contains a reflecting agent or a light absorbent, a layer containing it may be provided on the support surface as a separate layer, if desired.

Also, if desired, the support surface may be made faintly uneven or an adhesive layer for increasing adhesion to the phosphor layer or an electrically conductive layer may be provided as an undercoat layer. Examples of the reflecting agent include zinc oxide, titanium oxide and barium sulfate, however, since the phosphor has a short light emission wavelength, the reflecting agent is preferably titanium oxide or barium sulfate. The reflecting agent may be put into the presence not only in the support or between the support and the phosphor layer but also in the phosphor layer. In the case where the reflecting agent is present in the phosphor layer, it is preferably present partially in the vicinity of the support.

Examples of the binder for use in the screen according to the present invention include natural polymer materials such as protein (e.g., gelatin), polysaccharide (e.g., dextran, cornstarch) and gum arabi; synthetic polymer materials such as polyvinyl butyral, polyvinyl acetate, polyurethane, polyalkyl acrylate, vinylidene chloride, nitrocellulose, fluorine-containing polymer and polyester; and a mixture or copolymer thereof. The fundamental capability which a preferred binder must have is high transmissivity to the light emitted from the phosphor. In this point, gelatin, cornstarch, acrylic polymer, fluorine-containing olefin polymer, polymer containing a fluorine-containing olefin as a copolymer content and a styrene/acryl nitrile copolymer are preferred. The above-described binder may have a functional group capable of crosslinking by a crosslinking agent. Further, depending on the image quality performance required, the binder may contain an absorbent of the light emitted from the phosphor, or a binder having a low transmissivity may be used. The volume ratio of the phosphor to the binder is in general from 1:5 to 50:1, preferably from 1:1 to 15:1. The ratio of the phosphor to the binder may be uniform or may be non-uniform in the thickness direction.

The phosphor layer is usually formed by coating a coating solution obtained by dispersing a phosphor in a binder solution. Examples of the solvent for the coating solution include water, alcohol, chlorine-containing hydrocarbon, an organic solvent such as ketone, ester, ether and aromatic compound, and a mixture thereof.

The coating solution may contain a dispersion stabilizer for the phosphor particles, such as a phthalic acid, a stearic acid, a caproic acid or a surface active agent, or a plasticizer such as phosphoric ester, phthalic ester, glycolic ester, polyester or polyethylene glycol.

In the screen for use in the present invention, a protective layer may be provided on the phosphor layer. The protective layer is usually provided by coating it on the phosphor layer or laminating a protective layer prepared separately on the phosphor layer. In the coating method, the protective layer may be coated simultaneously with the phosphor layer or may be coated after the phosphor layer is coated and dried. The protective layer may comprise the same substance as the binder of the phosphor layer or may comprise a different substance. Examples of the substance for use in the protective layer include, in addition to the substances described for the binder of the phosphor layer, a cellulose derivative, polyvinyl chloride, melamine, phenolic resin and epoxy resin. Preferred examples of the substance include gelatin, cornstarch, an acrylic polymer, a fluorine-containing olefin polymer, a polymer containing a fluorine-containing olefin as a copolymer component and a styrene/acryl nitrile copolymer. The protective layer generally has a thickness of from 1 to 20 $\mu$m, preferably from 2 to 10 $\mu$m, more preferably from 2 to 6 $\mu$m. The surface of the protective layer for use in the present invention is preferably subjected to embossment. The protective layer may contain a matting agent, and depending on the image required, may contain a substance having a light scattering property to the light emitted, for example, titanium oxide.

The protective layer of the screen for use in the present invention may have a surface slipping property. Preferred examples of the slipping agent include a polysiloxane skeleton-containing oligomer and a perfluoroalkyl group-containing oligomer.

The protective layer for use in the present invention may have an electrically conductive property. The electrically conductive property-imparting agent includes a white inorganic electrically conductive substance, a transparent electrically conductive substance and an organic antistatic agent. Preferred examples of the inorganic electrically conductive substance include ZnO powder, whisker, $SnO_2$ and ITO.

The present invention will be described in greater detail with reference to the Examples, however, the present invention should not be construed as being limited thereto.

EXAMPLE 1

Preparation of {100} AgBrCl Tabular Emulsion A-1 (invention):

Into a reaction vessel, 15,860 ml of an aqueous gelatin solution (containing 19.5 g of Gelatin-1 (deionized alkali-processed ossein gelatin having a methionine content of about 40 μmol/g) and 7.8 ml of 1N solution of $H_2SO_4$, and having a pH of 4.3) and 13 ml of Solution NaCl-1 (containing 10 g of NaCl in 100 ml) were charged, and while keeping the temperature at 40° C., Solution Ag-1 (containing 20 g of $AgNO_3$ in 100 ml) and Solution X-1 (containing 3.44 g of NaCl and 7 g of KBr in 100 ml) were added simultaneously each in an amount of 31.2 ml at a rate of 124.8 ml/min. At this time, the pAg was 7.13. After stirring for 3 minutes, Solution Ag-2 (containing 2 g of $AgNO_3$ in 100 ml) and Solution X-2 (containing 9.84 g of KBr in 100 ml) were added simultaneously each in an amount of 56.4 ml at a rate of 161.14 ml/min. At this time, the pAg was 9.22. After stirring for 3 minutes, 135.2 ml of Solution Ag-1 was added over 1 minute and 5 seconds. At the same time, 93.6 ml of Solution X-1 was added and the addition was completed within 45 seconds. At this time, the pAg was 6.81. After stirring for 2 minutes, 224 ml of an aqueous gelatin solution (containing 13 g of oxidation treated gelatin, and 1 N solution of NaOH to adjust the pH to 5.5) was added, the temperature was raised to 75° C., the pCl was adjusted to 1.8 and then ripening was performed for 10 minutes. Thereafter, Disulfide Compound-A was added in an amount of $1\times10^{-4}$ mol per mol of silver halide. Further, Solution Ag-3 (containing 21.02 g of $AgNO_3$ in 100 ml) and Solution X-3 (containing 4.34 g of NaCl, 7.36 g of KBr and 5.1 g of low molecular weight gelatin having an average molecular weight of 15,000 in 100 ml) were simultaneously added to a mixing machine provided aside the reaction vessel each in an amount of 866 ml at a rate of 17.32 ml/min to prepare a fine grain emulsion, and the fine grain emulsion was immediately added to the reaction vessel. The fine grain obtained had an average size of 0.03 μm. After the addition, the emulsion was ripened for 10 minutes, a precipitant was added, the temperature was lowered to 35° C. and then the emulsion was washed with water by precipitation. An aqueous gelatin solution was added and the pH was adjusted at 60° C. to 6.0.

Disulfide Compound A:

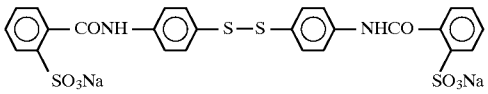

A transmission-type electron microphotographic image (hereinafter referred to as TEM) of a replica of the grain was observed. The resulting emulsion was a silver chlorobromide {100} tabular grain containing 51.5 mol % of AgBr on a silver basis. The characteristic values of the grain shape were as follows:

(entire projected area of tabular grains having an aspect ratio of from 1.5 to 30/sum of projected areas of all AgX grains)×100=$a_1$=95%

(average aspect ratio (average diameter/average thickness) of tabular grains)=$a_2$=9.3

(average diameter of tabular grains)=$a_3$=1.67 μm (average thickness)=$a_4$=0.18 μm The coefficient of variation of the Cl content distribution among the grains was measured by EPMA and found to be 5.5%.

Preparation of {100} AgBrCl Tabular Emulsion A-2 (invention):

{100} AgBrCl Tabular Emulsion A-2 was prepared in the same manner as Emulsion A-1 except that in the preparation of {100} AgBrCl Tabular Emulsion A-1, in place of adding Solution Ag-2 and Solution X-2, Solution Ag-2' (containing 2 g of $AgNO_3$ in 100 ml) and Solution X-2' (containing 9.84 g of KBr and 2.4 g of low molecular weight gelatin having an average molecular weight of 15,000 in 100 ml) were simultaneously added to a mixing machine provided aside the reaction vessel each in an amount of 56.4 ml at a rate of 161.14 ml/min to prepare a fine grain emulsion and the fine grain emulsion was immediately added to the reaction vessel. The characteristic values of the grain shape were as follows:

(entire projected area of tabular grains having an aspect ratio of from 1.5 to 30/sum of projected areas of all AgX grains)×100=$a_1$=96%

(average aspect ratio (average diameter/average thickness) of tabular grains)=$a_2$=9.4

(average diameter of tabular grains)=$a_3$=1.68 μm (average thickness)=$a_4$=0.18 μm Coefficient of variation of Cl content: 3.4%

Preparation of {100} AgBrCl Tabular Emulsion A-3 (comparison):

{100} AgBrCl Tabular Emulsion A-3 was prepared in the same manner as Emulsion A-1 except that in the preparation of {100} AgBrCl Tabular Emulsion A-1, the amount of Solution X-1 added simultaneously with the second time addition of Solution Ag-1 was increased to change the pAg to 8.13. The characteristic values of the grain shape were as follows:

(entire projected area of tabular grains having an aspect ratio of from 1.5 to 30/sum of projected areas of all AgX grains)×100=$a_1$=26%

(average aspect ratio (average diameter/average thickness) of tabular grains)=$a_2$=2.6

(average diameter of tabular grains)=$a_3$=1.1 μm (average thickness)=$a_4$=0.42 μm Coefficient of variation of Cl content: 15%

Preparation of {100} AgBrCl Tabular Emulsion A-4 (comparison):

{100} AgBrCl Tabular Emulsion A-4 was prepared in the same manner as Emulsion A-1 except that in the preparation of {100} AgBrCl Tabular Emulsion A-1, in simultaneously mixing Solution Ag-2 and X-2, the KBr amount contained in Solution X-2 was reduced to change the pAg to 7.50. The characteristic values of the grain shape were as follows:

(entire projected area of tabular grains having an aspect ratio of from 1.5 to 30/sum of projected areas of all AgX grains)×100=$a_4$=19%

(average aspect ratio (average diameter/average thickness) of tabular grains)=$a_2$=2.2

(average diameter of tabular grains)=$a_3$=1.0 μm (average thickness)=$a_4$=0.46 μm Coefficient of variation of Cl content: 13%

Preparation of {100} AgBrCl Tabular Emulsions A-5 to A-8:

{100} AgBrCl Tabular Emulsions A-5 to A-8 were prepared in the same manner as Emulsions A-1 to A-4, respectively, except that in the preparation of {100} AgBrCl Tabular Emulsions A-1 to A-4, in place of adding Solution Ag-3 and Solution X-3, Solution Ag-3' (containing 21.02 g of $AgNO_3$ in 100 ml) and Solution X-3' (containing 4.34 g of NaCl and 7.36 g of KBr in 100 ml) were simultaneously added to and mixed in the reaction vessel each in an amount of 866 ml at a rate of 17.32 ml/min. The characteristic values of the grain shape and the coefficient of variation of the Cl content were as shown in Tables 1 and 2 below.

Preparation of {100} AgBrCl Tabular Emulsions A-9 to A-12:

{100} AgBrCl Tabular Emulsions A-9 to A-12 were prepared in the same manner as Emulsions A-1 to A-4, respectively, except that in the preparation of {100} AgBrCl Tabular Emulsions A-1 to A-4, in place of adding Solution Ag-3 and Solution X-3, an AgBrCl fine grain emulsion previously prepared and corresponding to 182 g in terms of the amount of silver nitrate was added over 50 minutes. The

TABLE 1

| Emulsion | pAg After 1st Time Addition of Ag-1 and X-1 | pAg After Addition of Ag-2 and X-2 | pAg After 2nd Time Addition of Ag-1 and X-1 | Addition Method of Ag-2 and X-2 | Addition Method of Ag-3 and X-3 |
|---|---|---|---|---|---|
| A-1 | 7.13 | 9.22 | 6.81 | added as aqueous solution | fine grain emulsion prepared in the mixing machine |
| A-2 | 7.13 | 9.38 | 6.70 | fine grain emulsion | fine grain emulsion prepared in the mixing machine |
| A-3 | 7.13 | 9.22 | 8.13 | added as aqueous solution | fine grain emulsion prepared in the mixing machine |
| A-4 | 7.13 | 7.50 | 6.70 | added as aqueous solution | fine grain emulsion prepared in the mixing machine |
| A-5 | 7.13 | 9.22 | 6.81 | added as aqueous solution | added as aqueous solution |
| A-6 | 7.13 | 9.38 | 6.70 | fine grain emulsion | added as aqueous solution |
| A-7 | 7.13 | 9.22 | 8.13 | added as aqueous solution | added as aqueous solution |
| A-8 | 7.13 | 7.50 | 6.70 | added as aqueous solution | added as aqueous solution |
| A-9 | 7.13 | 9.22 | 6.81 | added as aqueous solution | fine grain emulsion previously prepared |
| A-10 | 7.13 | 9.38 | 6.70 | fine grain emulsion | fine grain emulsion previously prepared |
| A-11 | 7.13 | 9.22 | 8.13 | added as aqueous solution | fine grain emulsion previously prepared |
| A-12 | 7.13 | 7.50 | 6.70 | added as aqueous solution | fine grain emulsion previously prepared |
| B-1 | — | — | — | — | — |
| B-2 | — | — | — | — | — |
| B-3 | — | — | — | — | — |
| B-4 | — | — | — | — | — |

TABLE 2

| Emulsion | $a_1$ (%) | $a_2$ | $a_3$ (μm) | $a_4$ (82 m) | Face Index | Br (mol %) | Coefficient of Variation of Cl Content Distribution among Grains (%) | Remarks |
|---|---|---|---|---|---|---|---|---|
| A-1 | 95 | 9.3 | 1.67 | 0.16 | {100} | 51.5 | 5.5 | Invention |
| A-2 | 96 | 9.4 | 1.68 | 0.18 | {100} | 51.5 | 3.4 | Invention |
| A-3 | 26 | 2.6 | 1.10 | 0.42 | {100} | 51.5 | 15 | Comparison |
| A-4 | 19 | 2.2 | 1.00 | 0.46 | {100} | 51.5 | 13 | Comparison |
| A-5 | 85 | 7.6 | 1.60 | 0.21 | {100} | 51.5 | 6.2 | Invention |
| A-6 | 87 | 7.7 | 1.62 | 0.21 | {100} | 51.5 | 4.2 | Invention |
| A-7 | 23 | 1.9 | 0.95 | 0.44 | {100} | 51.5 | 17 | Comparison |
| A-6 | 17 | 1.7 | 0.80 | 0.46 | {100} | 51.5 | 15 | Comparison |
| A-9 | 88 | 8.3 | 1.65 | 0.20 | {100} | 51.5 | 5.8 | Invention |
| A-10 | 90 | 8.3 | 1.66 | 0.20 | {100} | 51.5 | 3.8 | Invention |
| A-11 | 25 | 2.3 | 0.95 | 0.42 | {100} | 51.5 | 16 | Comparison |
| A-12 | 20 | 2.0 | 0.90 | 0.46 | {100} | 51.5 | 14 | Comparison |
| B-1 | 90 | 9.3 | 1.67 | 0.18 | {100} | 0.44 | 4.5 | Comparison |
| B-3 | 90 | 8.6 | 1.55 | 0.18 | {111} | 50 | 8.2 | Comparison |
| B-3 | 90 | 9.3 | 1.67 | 0.16 | {100} | 20 | 5.5 | Comparison |
| B-4 | 95 | 9.3 | 1.67 | 0.18 | {111} | 100 | — | Comparison |

AgBrCl fine grain had a Br content of 50 mol % and an average grain size 0.05 μm. The characteristic values of the grain shape and the coefficient of variation of the Cl content were as shown in Tables 1 and 2 above.

Preparation of {100} High AgCl Tabular Emulsion B-1:

Into a reaction vessel, 1,582 ml of an aqueous gelatin solution (containing 19.5 g of Gelatin-1 (deionized alkali-processed ossein gelatin having a methionine content of about 40 μmol/g) and 7.8 ml of 1N solution of $HNO_3$, and having a pH of 4.3) and 13 ml of Solution NaCl-1 (containing 10 g of NaCl in 100 ml) were charged, and while keeping the temperature at 40° C., Solution Ag-1 (containing 20 g of $AgNO_3$ in 100 ml) and Solution X-1 (containing 7.05 g of NaCl in 100 ml) were added and mixed simultaneously each in an amount of 15.6 ml at a rate of 62.4 ml/min. After stirring for 3 minutes, Solution Ag-2 (containing 2 g of $AgNO_3$ in 100 ml) and Solution X-2 (containing 1.4 g of KBr in 100 ml) were mixed simultaneously each in an amount of 28.2 ml at a rate of 80.6 ml/min. After stirring for 3 minutes, Solution Ag-1 and Solution X-1 were added simultaneously each in an amount of 46.8 ml at a rate of 62.4 ml/min. After stirring for 2 minutes, 203 ml of an aqueous gelatin solution (containing 11.3 g of oxidation treated gelatin, 1.3 g of NaCl and 1N solution of NaOH to adjust the pH to 5.5) was added to give a pCl of 1.8, the temperature was raised to 75° C., the pCl was adjusted to 1.8 and then ripening was performed for 10 minutes. Then, Disulfide Compound A was added in an amount of $1\times10^{-4}$ mol per mol of silver halide and further an AgCl fine grain emulsion (average grain diameter: 0.1 μm) was added at a rate, in terms of the addition rate of AgCl, of $2.68\times10^{-2}$ mol/min over 20 minutes. After the addition, the emulsion was ripened for 10 minutes, a precipitant was added, the temperature was lowered to 35° C. and then the emulsion was washed with water by precipitation. An aqueous gelatin solution was added and the pH was adjusted at 60° C. to 6.0.

A transmission-type electron microphotographic image (hereinafter referred to as TEM) of a replica of the grain was observed. The resulting emulsion was a silver chlorobromide {100} tabular grain containing 0.44 mol % of AgBr on a silver basis. The characteristic values of the grain shape were as follows:

(entire projected area of tabular grains having an aspect ratio of from 2 to 30/sum of projected areas of all AgX grains)×100=$a_1$=90%

(average aspect ratio (average diameter/average thickness) of tabular grains)=$a_2$=9.3

(average diameter of tabular grains)=$a_3$=1.67 μm (average thickness)=$a_4$=0.18 μm Coefficient of variation of Cl content: 4.5%

Preparation of {111} AgBrCl Tabular Emulsion B-2:

Silver chlorobromide tabular grains were prepared as follows.

| | | |
|---|---|---|
| Solution (1): | Inactive gelatin | 30 g |
| | Crystal Habit Controlling Agent A | 0.6 g |
| | Crystal Habit Controlling Agent B | 0.4 g |
| | Crystal Habit Controlling Agent A: | |

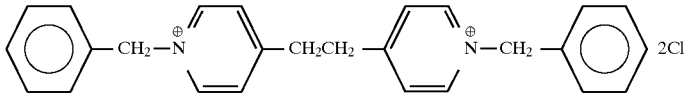

| | | |
|---|---|---|
| | Crystal Habit Controlling Agent B: | |

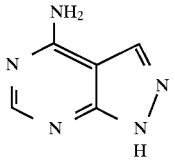

| | | |
|---|---|---|
| | NaCl | 2 g |
| | KBr | 4.1 g |
| | $H_2O$ | 1,750 ml |
| Solution (2): | $AgNO_3$ | 7.6 g |
| | $H_2O$ to make | 30 ml |
| Solution (3): | NaCl | 1.4 g |
| | KBr | 2.9 g |
| | $H_2O$ to make | 30 ml |
| Solution (4): | $AgNO_3$ | 24.5 g |
| | $H_2O$ to make | 96 ml |
| Solution (5): | NaCl | 0.15 g |
| | KBr | 0.31 g |
| | $H_2O$ to make | 65 ml |
| Solution (6): | $AgNO_3$ | 101.9 g |
| | $H_2O$ to make | 400 ml |
| Solution (7): | NaCl | 18.8 g |
| | KBr | 38.3 g |
| | $H_2O$ to make | 400 ml |

To Solution (1) kept at 35° C., Solution (2) and Solution (3) were added simultaneously while stirring at a constant addition rate over 1 minute and the temperature of the solution was elevated to 70° C. over 15 minutes. At this time, grains corresponding to about 5.7% of all silver amount were formed. Then, Solution (4) and Solution (5) were added simultaneously at a constant addition rate over 24 minutes and further, Solution (6) and Solution (7) were simultaneously added over 40 minutes to obtain a silver chlorobromide tabular emulsion.

The emulsion was washed with water and desalted by precipitation, 30 g of gelatin and $H_2O$ were added thereto, 2.0 g of phenoxyethanol and 0.8 g of sodium polystyrenesulfonate as a thickener were added, and the emulsion was redispersed by caustic soda to have a pH of 6.0.

The thus-obtained emulsion was a silver chlorobromide tabular emulsion having $a_1$=90%, $a_3$=1.55 μm, $a_4$=0.18 μm, $a_2$=8.6, a coefficient of variation of the circle-corresponding projected area diameter of 19%, a coefficient of variation of the Cl content of 8.2%, {111} face as major faces and a Cl content of 50 mol %.

Preparation of {100} Face $AgBr_{20}Cl_{80}$ Tabular Emulsion B-3:

Into a reaction vessel, 1,582 ml of an aqueous gelatin solution (containing 19.5 g of Gelatin-1 (deionized alkali-processed ossein gelatin having a methionine content of about 40 μmol/g) and 7.8 ml of 1N solution of $HNO_3$, and having a pH of 4.3) and 13 ml of Solution NaCl-1 (containing 10 g of NaCl in 100 ml) were charged, and while keeping the temperature at 40° C., Solution Ag-1 (containing 20 g of $AgNO_3$ in 100 ml) and Solution X-1 (containing 7.05 g of NaCl in 100 ml) were added mixed simultaneously each in an amount of 15.6 ml at a rate of 62.4 ml/min. After stirring for 3 minutes, Solution Ag-2 (containing 2 g of $AgNO_3$ in 100 ml) and Solution X-2 (containing 1.4 g of KBr in 100 ml) were added simultaneously each in an amount of 28.2 ml at a rate of 80.6 ml/min. After stirring for 3 minutes, Solution Ag-1 and Solution X-1 were added and mixed simultaneously each in an amount of 46.8 ml at a rate of 62.4 ml/min. After stirring for 2 minutes, 203 ml of an aqueous gelatin solution (containing 13 g of Gelatin-1, 1.3 g of NaCl and 1N solution of NaOH to adjust the pH to 5.5) was added to give a pCl of 1.8, the temperature was raised to 75° C., the pCl was adjusted to 1.8 and then ripening was performed for 10 minutes. Thereafter, Solution Ag-3 (containing 25 g of $AgNO_3$ in 100 ml) and Solution X-3 (containing 3.5 g of KBr and 6.02 g of NaCl in 100 ml) were added at an addition rate of $2.68\times10^{-2}$ mol/min by a controlled double jet method and the emulsion was grown at a pCl of 1.8 for 20 minutes.

After the addition, the emulsion was ripened for 10 minutes, a precipitant was added, the temperature was lowered to 35° C. and then the emulsion was washed with water by precipitation. An aqueous gelatin solution was added and the pH was adjusted at 60° C. to 6.0. A TEM image of a replica of the grain was observed. The resulting emulsion was a silver chlorobromide {100} face tabular grain containing about 20 mol % of AgBr on a silver basis. The characteristic values of the grain shape were as follows:

(entire projected area of tabular grains having an aspect ratio of from 1.5 to 30/sum of projected areas of all AgX grains)×100 $a_1$=90%

(average aspect ratio (average diameter/average thickness) of tabular grains)=$a_2$=9.3

(average diameter of tabular grains)=$a_3$=1.67 μm (average thickness)=$a_4$=0.18 μm Coefficient of variation of Cl content: 5.5%

Preparation of {111} AgBr Tabular Grain B-4:

Into a vessel kept at 55° C. and containing 1 l of water having added thereto 6.0 g of potassium bromide and 7.0 g of a low molecular weight gelatin having an average molecular weight of 15,000, 37 ml of an aqueous silver nitrate solution (silver nitrate: 4.00 g) and 38 ml of an aqueous solution containing 5.9 g of potassium bromide were added while stirring by a double jet method over 37 seconds. Then, 18.6 g of gelatin was added, the temperature was raised to 70° C. and 89 ml of an aqueous silver nitrate solution (silver nitrate: 9.80 g) was added over 22 minutes. Here, 7 ml of a 25% aqueous ammonia solution was added, the emulsion was physically ripened for 10 minutes at the same temperature and then 6.5 ml of a 100% acetic acid solution was added. Subsequently, an aqueous solution containing 153 g of silver nitrate and an aqueous solution of potassium bromide were added while keeping the pAg at 8.5 by a controlled double jet method over 35 minutes. Then, 15 ml of 2N of potassium thiocyanate solution was added. After effecting physical ripening at the same temperature for 5 minutes and then, the temperature was lowered to 35° C. As a result, monodisperse pure silver bromide tabular grains having $a_1$=95%, $a_3$ (average projected area diameter)=1.67 μm, $a_4$ (thickness)=0.18 μm, $a_2$ (average aspect ratio)=9.3 and a coefficient of variation of the diameter of 18.5% were obtained.

Thereafter, soluble salts were removed by a precipitation method. The temperature was again raised to 40° C., then, 30 g of gelatin, 2.35 g of phenoxyethanol and 0.8 g of sodium polystyrenesulfonate as a thickener were added and the pH and the pAg were adjusted to 5.90 and 8.00, respectively, with caustic soda and silver nitrate solution.

Chemical Sensitization:

Emulsion A-1 was subjected to optimal chemical sensitization in the state kept at 56° C. while stirring. First, Thiosulfonic Acid Compound-1 corresponding to $6\times10^{-5}$mol per mol of silver halide was added. Then, AgBr fine grains having a sphere-corresponding diameter of 0.05 μm and corresponding to 1.0 mol % per mol of silver halide were added and the emulsion was ripened for about 5 minutes. Further, a 1% KI aqueous solution corresponding to 0.2 mol % per mol of silver halide was added.

After 3 minutes, $1\times10^{-6}$ mol/mol-Ag of thiourea dioxide was added, and while keeping the state for 22 minutes, reduction sensitization was effected.

Thereafter, 4-hydroxy-6-methyl-1,3,3a,7-tetraazaindene corresponding to $1.5\times10^{-4}$ mol per mol of silver halide was added, and Sensitizing Dye A-1 dispersion corresponding to, in terms of the amount of Sensitizing Dye A-1, $1\times10^{-3}$ mol per mol of silver halide and Sensitizing Dye A-2 corresponding to $1.2\times10^{-5}$ mol per mol of silver halide were simultaneously added.

Subsequently, sodium thiosulfate corresponding to $5\times10^{-6}$ mol per mol of silver halide and Selenium Compound I corresponding to $1\times10^{-6}$ mol per mol of silver halide were added, and then, chloroauric acid corresponding to $2.7\times10^{-6}$ mol per mol of silver and potassium thiocyanate corresponding to $1.8\times10^{-3}$ mol per mol of silver halide were added. Further, a nucleic acid (RNA-F, trade name, produced by Sanyo Kokusaku Pulp KK) corresponding to 67 mg per mol of silver halide was added. Twenty (20) minutes after the addition of chloroauric acid, sodium sulfite corresponding to $3.2\times10^{-4}$ mol per mol of silver was added and the emulsion was further ripened. Eighty (80) minutes after the addition of chloroauric acid, Water-Soluble Mercapto Compound 1 was added and then the emulsion was cooled to 35° C.

Thus, the preparation (chemical ripening) of Emulsion A-1 was completed.

Thiosulfonic Acid Compound 1

$C_2H_5SO_2SNa$

Sensitizing Dye A-1

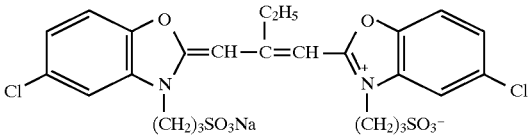

Sensitizing Dye A-2

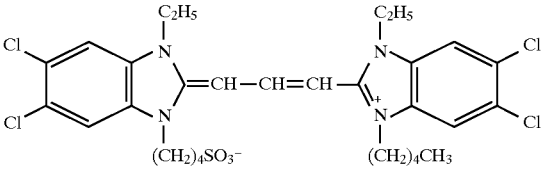

Selenium Compound 1

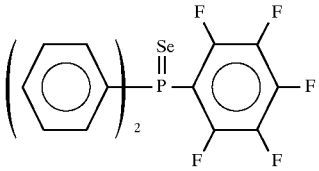

Water-Soluble Mercapto Compound 1

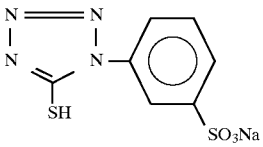

Preparation of Sensitizing Dye A-1 Dispersion:

Sensitizing Dye A-1 in an amount of 1 g per 50 ml of water was mechanically dispersed into solid fine grains of 1 μm or less at a pH of 7.0±0.5 and a temperature of from 50° to 65° C. using a dissolver at a revolution number of from 2,000 to 2,500 rpm, 50 g of a 10% gelatin was added thereto and mixed, and the mixture was cooled.

In the same manner as Emulsion A-1, Emulsions A-2 to A-12 and B-1 to B-4 were subjected to respective optimal chemical sensitization.

Preparation of Coated Sample:

To each of Emulsions A-1 to A-12 and B-1 to B-4, the following chemicals were added in an amount shown below per mol of silver halide to prepare emulsion coating solutions.

| | |
|---|---|
| Gelatin (including gelatin in emulsion) | 111 g |
| Dextran (average molecular weight: 39,000) | 21.5 g |
| Trimethylolpropane | 9.0 g |
| Sodium polyacrylate (average molecular weight: 400,000) | 5.1 g |
| Sodium polystyrenesulfonate (average molecular weight: 600,000) | 1.2 g |
| Hardener: 1,2-bis(vinylsulfonylacetamido)ethane controlled to give a swelling ratio of 170% | |
| Compound I | 42.1 mg |
| Compound II | 10.3 g |
| Compound III | 0.11 g |
| Compound IV | 8.5 mg |
| Compound V | 0.43 g |
| Compound VI | 4 mg |
| Compound VII | 57.4 mg |
| Compound VIII | 20 mg |
| Compound IX | 30 mg |
| Polymer Lx-1 | 0.4 g |
| Colloidal silica (particle size: 0.014 μm) | 0.5 g |
| pH adjusted with NaOH | 6.1 |

Compound I

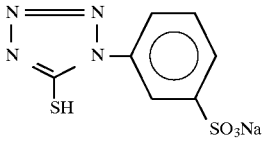

Compound II

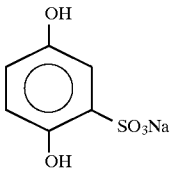

Compound III

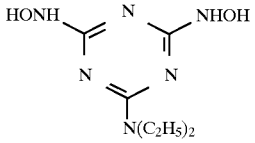

Compound IV

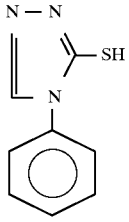

-continued

Compound V

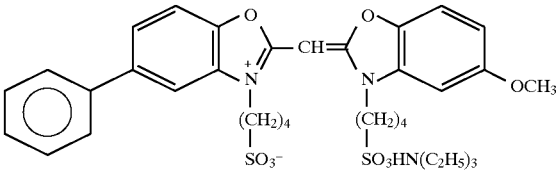

Compound VI

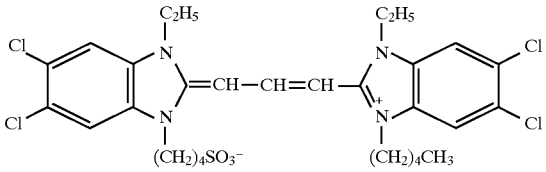

Compound VII

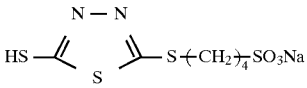

Compound VIII

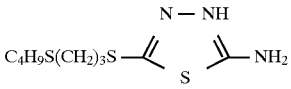

Compound IX

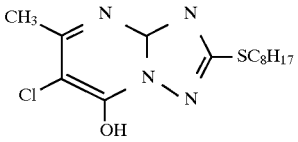

To each of the coating solutions prepared above, Dye Emulsified Product A was added so as to give a coverage of Dye I of 10 mg/m$^2$ per one surface.

Dye I

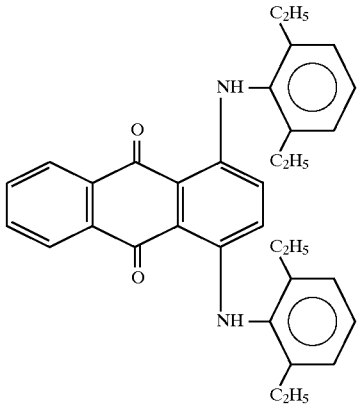

Preparation of Dye Emulsified Product A:

Dye I shown above (60 g), 62.8 g of High Boiling Point Organic Solvent I shown below, 62.8 g of High Boiling Point Organic Solvent II shown below and 333 g of ethyl acetate were dissolved at 60° C. Then, 65 ml of a 5% aqueous solution of sodium dodecylsulfonate, 94 g of gelatin and 581 ml of water were added and emulsion-dispersed in a dissolver at 60° C. for 30 minutes. Thereafter, 2 g of methyl p-hydroxybenzoate and 6 l of water were added and the temperature was lowered to 40° C. The resulting solution was concentrated until the total amount was reduced to 2 kg using Ultrafiltration Labo Module ACP1050 manufactured by Asahi Chemical Industry Co., Ltd. and thereto, 1 g of methyl p-hydroxybenzoate was added to obtain Dye Emulsified Product A.

High Boiling Point Organic Solvent I

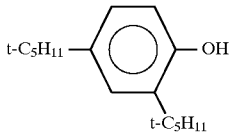

High Boiling Point Organic Solvent II

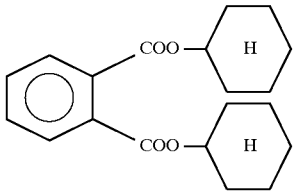

Preparation of Coating Solution for Surface Protective Layer:

The coating solution for the surface protective layer was prepared to have a coating amount of each component as described below.

| | |
|---|---|
| Gelatin | 0.780 g/m$^2$ |
| Sodium polyacrylate (average molecular weight: 400,000) | 0.035 g/m$^2$ |
| Sodium polystyrenesulfonate (average molecular weight: 600,000) | 0.0012 g/m$^2$ |
| Methacrylic acid:methyl methacrylate: styrene = 7:76:17 copolymer (average particle size: 4.0 μm) | 0.074 g/m$^2$ |
| Coating Aid I | 0.014 g/m$^2$ |
| Coating Aid II | 0.036 g/m$^2$ |
| Coating Aid III | 0.0069 g/m$^2$ |
| Coating Aid IV | 0.0032 g/m$^2$ |
| Coating Aid V | 0.0012 g/m$^2$ |
| Compound X | 0.0008 g/m$^2$ |
| 4-Hydroxy-6-methyl-1,3,3a,7-tetrazaindene | 0.0057 g/m$^2$ |
| Compound XI | 0.0007 g/m$^2$ |
| Proxel | 0.0010 g/m$^2$ |
| pH adjusted with NaOH | 6.8 |

Coating Aid I

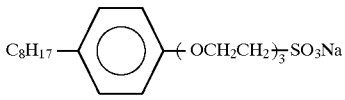

Coating Aid II

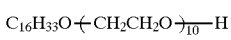

Coating Aid III

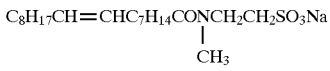

Coating Aid IV

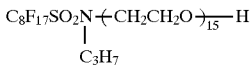

-continued

Coating Aid V

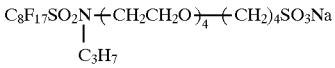

Compound X

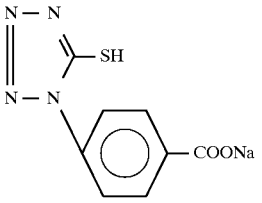

Compound XI

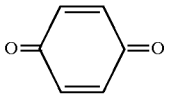

Preparation of Coating Solution for Interlayer of Dye for Detecting Infrared Site:

| | |
|---|---|
| Gelatin | 0.50 g/m$^2$ |
| Benzoisothiazolone | 1.4 mg/m$^2$ |
| Sodium polyacrylate (average molecular weight: 41,000) | 17 mg/m$^2$ |
| Dispersion of Infrared Dye Compound 1 | 20 mg/m$^2$ (as dye solids content) |

Preparation of Support:

(1) Preparation of Dye Dispersion B for Undercoat Layer

Dye II shown below was treated in a ball mill according to the method described in JP-A-63-197943.

Dye II:

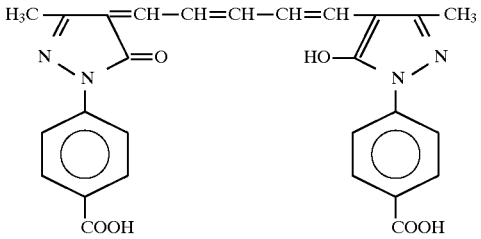

Into a 2 l-volume ball mill, 434 ml of water and 791 ml of a 6.7% aqueous solution of a surface active agent Triton X200 (trademark) (TX-2000 (trademark)) were charged. To the resulting solution, 20 g of the dye was added. Then, 400 ml of zirconium oxide ($ZrO_2$) beads (diameter: 2 ml) were added thereto and the content was crushed for 4 days. Thereafter, 160 g of a 12.5% gelatin was added. After defoaming, $ZrO_2$ beads were removed by filtration. When the resulting dye dispersion was observed, the crushed dye had a wide particle size distribution of from 0.05 to 1.15 $\mu$m and the average particle size was 0.37 $\mu$m.

Dye particles having a size of 0.9 $\mu$m or more were removed by centrifugal separation.

Thus, Dye Dispersion B was obtained.

(2) Preparation of Support

A biaxially stretched polyethylene terephthalate film having a thickness of 175 $\mu$m was subjected to surface treatment with corona discharge and thereon, a first undercoating solution having the following composition was coated by a wire convertor to give a coating amount of 4.9 ml/m$^2$ and dried at 185° C. for 1 minute.

On the opposite surface, the first undercoat layer was provided in the same manner. The polyethylene terephthalate used contained the following dyes.

| | |
|---|---|
| Dye III | 0.04 wt % |
| Dye IV | 0.02 wt % |
| Dye V | 0.02 wt % |

Dye III

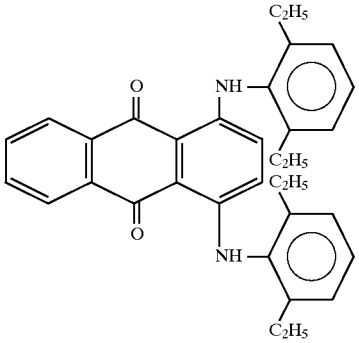

Dye IV

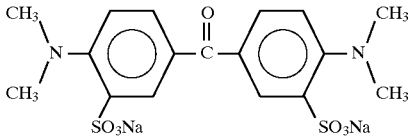

Dye V

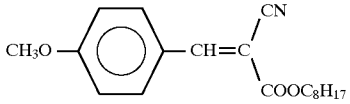

First Undercoating Solution:

| | |
|---|---|
| Butadiene-styrene copolymer latex solution (solids content: 40%, butadiene/styrene = 31/69 by weight) | 158 ml |
| 2,4-Dichloro-6-hydroxy-s-triazine sodium salt 4% solution | 41 ml |
| Distilled water | 801 ml |

*The latex solution contained the following compound as an emulsion dispersant in an amount of 0.4 wt % based on the latex solids content.

Emulsion Dispersant

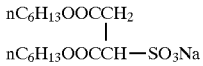

(3) Coating of Undercoat Layer

On the above-described first undercoat layer provided on both surfaces of the film, a second undercoat layer having the following composition was coated by a wire bar coder method to have the coating amount shown below and then dried at 155° C.

| | |
|---|---|
| Gelatin | 80 mg/m$^2$ |
| Dye Dispersion B (as dye solids content) | 8 mg/m$^2$ |
| Coating Aid VI | 1.8 mg/m$^2$ |
| Proxel | 0.27 mg/m$^2$ |

-continued

| | |
|---|---|
| Matting Agent: | |
| polymethyl methacrylate having an average particle Size of 2.5 μm | 2.5 mg/m$^2$ |
| Coating Aid VI | |
| $C_{12}H_{25}O(CH_2CH_2O)_{10}H$ | |

Preparation of Photographic Material:

On both surfaces of the thus prepared support, the emulsion layer, the surface protective layer and the interlayer of dye for detecting infrared site prepared above were coated by the co-extrusion method. The interlayer of dye for detecting infrared site was provided in the middle between the emulsion layer and the support. The coated silver amount was 1.75 g/m$^2$ per one surface. In this way, Coated Samples 1 to 16 were prepared.

Evaluation of Photographic Material:

An X-Ray AD System Screen HGM manufactured by Fuji Photo Film Co., Ltd. was firmly attached onto both surfaces of each of the photographic materials prepared above and exposed to light from both surfaces for 0.05 second to effect X-ray sensitometry.

The exposure amount was controlled by varying the distance between the X-ray bulb and the cassette. After the exposure, each sample was processed in an automatic developing machine using the following developer and fixing solution.

Processing:

Automatic Developing Machine:

CEPROS-30 manufactured by Fuji Photo Film Co., Ltd.

| | |
|---|---|
| Developer: | |
| Part Agent A: | |
| Potassiuin hydroxide | 330 g |
| Potassium suifite | 630 g |
| Sodium sulfite | 255 g |
| Potassium carbonate | 90 g |
| Boric acid | 45 g |
| Diethylene glycol | 180 g |
| Diethylenetriaminepentaacetic acid | 30 g |
| 1-(N,N-Diethylamine)ethyl-5-mercapto-tetrazole | 0.75 g |
| Hydroquinone | 450 g |
| 4-Hydroxymethyl-4-methyl-1-phenyl-3-pyrazolidone | 60 g |
| Water to make | 4,125 ml |
| Part Agent B: | |
| Diethylene glycol | 525 g |
| 3,3'-Dithiobishydrosuccinic acid | 3 g |
| Glacial acetic acid | 102.6 g |
| 2-Nitroindazole | 3.75 g |
| 1-Phenyl-3-pyrazolidone | 34.5 g |
| Water to make | 750 ml |
| Part Agent C | |
| Glutaraldehyde (50 wt/wt %) | 150 g |
| Potassium bromide | 15 g |
| Potassium metabisulfite | 105 g |
| Water to make | 750 ml |
| Fixing Solution: | |
| Ammonium thiosulfate (70 wt/vol %) | 3,000 ml |
| Disodium ethylenediamine tetraacetate dihydrate | 0.45 g |
| Sodium sulfite | 225 g |
| Boric acid | 60 g |
| 1-(N,N-Diethylamine)-ethyl-5-mercaptotetrazole | 15 g |
| Tartaric acid | 48 g |
| Glacial acetic acid | 675 g |
| Sodium hydroxide | 225 g |

-continued

| | |
|---|---|
| Sulfuric acid (36N) | 58.5 g |
| Aluminum sulfate | 150 g |
| Water to make | 6,000 ml |
| pH | 4.68 |

Preparation of Processing Solution:

The developer concentrated solution prepared above was charged into the following container by placing respective part agents one by one. The container comprises respective part containers for Part Agents A, B and C and these part containers are combined by themselves into one.

The fixing concentrated solution prepared above was also charged into the same container.

To the development tank, 300 ml of an aqueous solution containing 54 g of acetic acid and 55.5 g of potassium bromide, as a starter, was added.

Each of the containers housing the above-described processing solutions was turned upside down, inserted into a piercing blade of the processing solution stock tank installed on the side of the automatic developing machine to tear the sealing film of the cap, thereby charging each processing solution housed in the container into the stock tank.

Each processing solution was filled in the developing tank or the fixing tank by working the pump installed to the developing machine to have the constitutional proportion described below.

Further, every 8 sheet processing of the light-sensitive material in a 10×12 inch size, the processing agent stock solutions and water were mixed in the same proportion and replenished to the processing tank of the automatic developing machine.

| | |
|---|---|
| Developer: | |
| Part Solution A | 51 ml |
| Part Solution B | 10 ml |
| Part Solution C | 10 ml |
| Water | 125 ml |
| pH | 10.50 |
| Fixing Solution: | |
| Concentrated solution | 80 ml |
| Water | 120 ml |
| pH | 4.62 |

In the water washing tank, tap water was filled.

As a deposit inhibitor, three polyethylene-made bottles (the orifice of each bottle was covered by a 300-mesh nylon cloth, and water and microbes can flow through this cloth) each packed with 0.4 g of perlite having an average particle size of 100 μm and an average pore size of 3 μm and having carried thereon Actinomyces were prepared. Out of three bottles prepared, two were sunk on the bottom of the water washing tank, and one on the bottom of the washing water stock tank (liquid quantity: 0.2 l).

| Processing Speed and Processing Tank: | | |
|---|---|---|
| Development | 35° C. | 8.8 seconds |
| Fixing | 32° C. | 7.7 seconds |
| Water washing | 17° C. | 3.8 seconds |
| Squeezing | | 4.4 seconds |
| Drying | 58° C. | 5.3 seconds |
| Total | 30 seconds | |

-continued

| Replenishing Amount: | |
|---|---|
| Developer | 8 ml/10 × 12 inch |
| Fixing solution | 8 ml/10 × 12 inch |

Evaluation of Fixability:

Using the processing solution and the automatic developing machined described above, Photographic Materials 1 to 16 each cut into a size of 10×12 inch were processed without passing through exposure. Whether or not fixing was achieved was evaluated by visually observing the processed film. The results obtained are shown in Table 3.

The sensitivity is expressed by the reciprocal of the exposure amount necessary for giving Fog+1.0, and the sensitivity of Photographic Material 1 is taken as 100. The change in density of the light quantity on the straight line connecting the points of giving density 0.2 and density 1.0, to the natural logarithm is used as Gradation G.

TABLE 3

| Photographic Material | Emulsion | Sensitivity | Fog | Fixability | Gradation |
|---|---|---|---|---|---|
| 1 | A-1 | 100 | 0.03 | fixed | 2.4 |
| 2 | A-2 | 101 | 0.03 | fixed | 2.5 |
| 3 | A-3 | 43 | 0.08 | fixed | 2.0 |
| 4 | A-4 | 36 | 0.09 | fixed | 2.1 |
| 5 | A-5 | 92 | 0.04 | fixed | 2.3 |
| 6 | A-6 | 94 | 0.04 | fixed | 2.4 |
| 7 | A-7 | 26 | 0.09 | fixed | 1.9 |
| 8 | A-8 | 23 | 0.11 | fixed | 2.0 |
| 9 | A-9 | 98 | 0.03 | fixed | 2.4 |
| 10 | A-10 | 99 | 0.03 | fixed | 2.5 |
| 11 | A-11 | 32 | 0.09 | fixed | 1.9 |
| 12 | A-12 | 29 | 0.10 | fixed | 2.0 |
| 13 | B-1 | 70 | 0.05 | fixed | 2.3 |
| 14 | B-2 | 60 | 0.08 | fixed | 2.1 |
| 15 | B-3 | 75 | 0.07 | fixed | 2.2 |
| 16 | B-4 | 112 | 0.04 | not fixed | 2.4 |

As seen in Table 3, the emulsions of the present invention only are excellent all in the fog, the sensitivity, the gradation and the fixability at the same time.

EXAMPLE 2

Ultra Vision First Detail (UV) manufactured by Du Pont was firmly attached onto both surfaces of each of Photographic Materials 1 to 16 prepared in Example 1 and exposed to light from both surfaces for 0.05 second to effect X-ray sensitometry.

The exposure amount was controlled by varying the distance between the X-ray bulb and the cassette. After the exposure, each sample was processed in an automatic developing machine with the following developer.

Preparation of Concentrated Developer:

Concentrated Developer A containing sodium erythorbate as a developing agent was prepared according to the following formulation.

| | |
|---|---|
| Diethylenetraiminepentaacetic acid | 8.0 g |
| Sodium sulfite | 20.0 g |
| Sodium carbonate monohydrate | 52.0 g |
| Potassium carbonate | 55.0 g |
| Sodium erythorbate | 60.0 g |
| 4-Hydroxymethyl-4-methyl-1-phenyl-3-pyrazolidone | 13.2 g |
| 3,3'-Diphenyl-3,3'-dithiopropionic acid | 1.44 g |
| Diethylene glycol | 50.0 g |
| Development Accelerator 1 | 1.0 g |
| Development Accelerator 2 | 1.0 g |
| pH adjusted with sodium hydroxide | 10.4 |

Development Accelerator 1

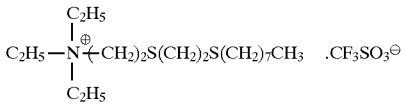

Development Accelerator 2

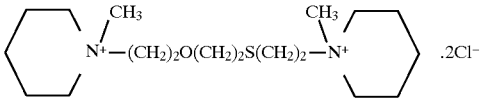

Preparation of Developer Replenisher:

The above-described concentrated developer was 2-fold diluted and used as the developer replenisher.

Preparation of Developer Mother Solution:

The above-described concentrated developer (2 l) was diluted with water to make 4 l and a starter having the following composition was added thereto in an amount of 60 ml per 1 l of the diluted developer to obtain a developer having a pH of 9.5, and this was used as the developer mother solution.

Starter Solution:

| | |
|---|---|
| Potassium bromide | 11.7 g |
| Acetic acid (90%) | 12.0 g |
| Water to make | 60 ml |

Preparation of Concentrated Fixing Solution:

A concentrated fixing solution was prepared according to the following formulation.

| | |
|---|---|
| Water | 0.5 l |
| Ethylenediaminetetraacetic acid dihydrate | 0.05 g |
| Sodium thiosulfate | 290.0 g |
| Sodium bisulfite | 98.0 g |
| Sodium hydroxide | 2.9 g |
| pH adjusted with NaOH | 5.2 |
| Water to make | 1 l |

Preparation of Fixing Replenisher:

The above-described concentrated fixing solution was 2-fold diluted and used as the fixing replenisher.

Preparation of Fixing Mother Solution:

The above-described concentrated fixing solution (2 l) was diluted with water to make 4 l. The fixing solution obtained had a pH of 5.4.

Processing of Photographic Material:

Each photographic material was processed in an automatic developing machine CEPROS-30 manufactured by Fuji Photo Film Co., Ltd., of which drive system was modified and also numerical aperture was modified to 0.02, using the developer mother solution and the fixing mother solution prepared above while supplying the developer replenisher and the fixing replenisher each in an amount of 80 ml per $m^2$ of the light-sensitive material.

| Step | Temperature | Processing Time |
|---|---|---|
| Insertion | — | 2 seconds |
| Development | 35° C. | 8 seconds |
| Fixing | 35° C. | 8 seconds |
| Water washing | 18° C. | 5 seconds |
| Squeezing | | 2 seconds |
| Drying | 55° C. | 5 seconds |
| Total (Dry to Dry) | | 30 seconds |

It is verified that the light-sensitive materials and the processing solutions of the present invention exhibit excellent photographic capability.

EXAMPLE 3

Coating Solution for Emulsion Layer:

To each of Emulsions A-1 to A-12 and B-1 to B-3 prepared in Example 1 and subjected to chemical sensitization, the following chemicals were added in an amount shown below per mol of silver halide to prepare coating solutions.

| | |
|---|---|
| 2,6-Bis(hydroxyamino)-4-diethylamino-1,3,5-triazine | 72.0 mg |
| Dextran (average molecular weight: 39,000) | 3.9 g |
| Potassium polystyrenesulfonate (average molecular weight: 600,000) | 0.7 g |
| Compound I | 7.0 mg |
| Sodium hydroquinonemonosulfonate | 8.2 g |
| Snowtex C (produced by Nissan Chemical KK) | 10.5 g |
| Ethyl acrylate/methacrylic acid (97/3) copolymer latex | 9.7 g |
| Gelatin | controlled to give a coated weight in the emulsion layer of 2.6 g/m$^2$ |
| Hardener: | 1,2-bis (vinylsulfonylacetamido)ethane controlled to give a swelling ratio of 230% |

Preparation of Coating Solution for Surface Protective Layer:

Coating Solution b-1 was prepared to have a coating amount of each component as described below.

| | |
|---|---|
| Gelatin | 650 mg/m$^2$ |
| Sodium polyacrylate (average molecular weight: 400,000) | 18 g/m$^2$ |
| Butyl acrylate/methacrylic acid (4/6) copolymer latex (average molecular weight: 120,000) | 120 mg/m$^2$ |
| Coating Aid I | 18 mg/m$^2$ |
| Coating Aid II | 45 mg/m$^2$ |
| Coating Aid IV | 0.9 mg/m$^2$ |
| Coating Aid V | 0.61 mg/m$^2$ |
| Coating Aid VII | 26 mg/m$^2$ |
| Compound X | 1.3 mg/m$^2$ |
| Polymethyl methacrylate (average particle size: 2.5 $\mu$m) | 87 mg/m$^2$ |
| Proxel | 0.5 mg/m$^2$ |

-continued

| | |
|---|---|
| Potassium polystyrenesulfonate (average molecular weight: 600,000) | 0.9 mg/m$^2$ |
| pH adjusted with NaOH | 7.4 |

Coating Aid VII

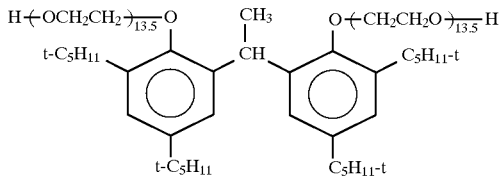

Preparation of Coating Solution for Back Surface: Antihalation Layer:

(1) Preparation of Dye Dispersion L

Dye I and High Boiling Point Organic Solvents I and II each in an amount of 2.5 g were dissolved in 50 ml of ethyl acetate, the resulting solution was mixed with 90 g of a 8% aqueous gelatin solution containing 1.5 g of sodium dodecylbenzenesulfonate and 0.18 g of methyl p-hydroxybenzoate at 60° C., and the mixture was subjected to high-speed stirring in a homogenizer. After the completion of high-speed stirring, the pressure was reduced at 80° C. using an evaporate to remove 92 wt % of ethyl acetate. As a result, Dye Dispersion L having an average particle size of 0.18 $\mu$m was obtained.

(2) Preparation of Coating Solution

A coating solution was prepared to have a coating amount of each component as shown below.

| | |
|---|---|
| Gelatin | 2.0 g/m$^2$ |
| Phosphoric acid | 5.2 mg/m$^2$ |
| Snowtex C (produced by Nissan Chemical KK) | 0.5 g/m$^2$ |
| Ethyl acrylate/methacrylate acid (97/3) copolymer latex | 0.5 g/m$^2$ |
| Proxel | 4.2 mg/m$^2$ |
| Dye Dispersion L | 8.0 g/m$^2$ |
| Dye VI | 75 mg/m$^2$ |
| Dye VII | 50 mg/m$^2$ |
| Dye VIII | 50 mg/m$^2$ |

-continued

| | |
|---|---|
| Hardening agent: | 40 mg/m$^2$ |
| 1,2-Bis(vinylsulfonylacetamido)ethane | |

Dye VI

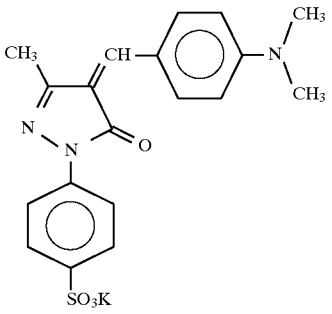

Dye VII

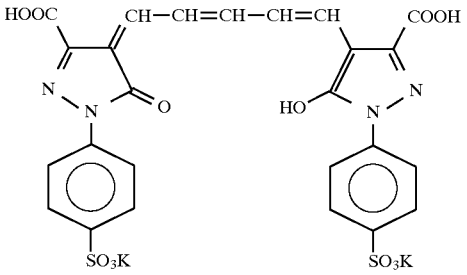

Dye VIII

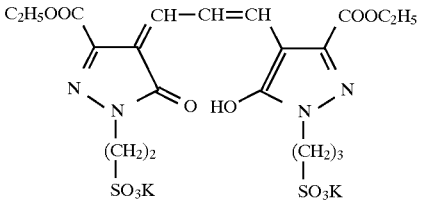

Surface Protective Layer:

A coating solution was prepared to have a coating amount of each component as shown below.

| | |
|---|---|
| Gelatin | 1,000 mg/m$^2$ |
| Polymethyl methacrylate: | |
| (average particle size: 3.5 $\mu$m) | 20 mg/m$^2$ |
| (average particle size: 0.75 $\mu$m) | 81 mg/m$^2$ |
| Coating Aid I | 20 mg/m$^2$ |
| Coating Aid II | 40 mg/m$^2$ |
| Coating Aid IV | 6 mg/m$^2$ |
| Coating Aid V | 9 mg/m$^2$ |
| Coating Aid VIII | 1.7 mg/m$^2$ |
| Coating Aid IX | 13 mg/m$^2$ |
| Proxel | 1.3 mg/m$^2$ |

-continued

| | |
|---|---|
| Potassium polystyrenesulfonate (average molecular weight: 600,000) | 2 mg/m$^2$ |
| NaOH | 2.5 mg/m$^2$ |

Coating Aid VIII
$C_8H_{17}SO_3K$
Coating Aid IX

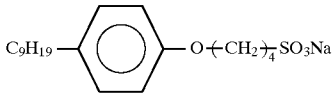

Preparation of Support:

A biaxially stretched polyethylene terephthalate film having a thickness of 183 $\mu$m was subjected to surface treatment with corona discharge and thereon, a first undercoating solution having the following composition was coated by a wire bar coater to give a coating amount of 5.1 ml/m$^2$ and dried at 175° C. for 1 minute. On the opposite surface, the first undercoat layer was provided in the same manner. The polyethylene terephthalate used contained 0.04 wt % of Dye III.

| | |
|---|---|
| Butadiene-styrene copolymer latex splution (solids content: 40%, butadiene/styrene = 31/35 by weight) | 79 ml |
| 2,4-Dichloro-6-hydroxy-s-triazine sodiuin salt 4% aqueous solution | 20.5 ml |
| Distilled water | 900.5 ml |

*In the latex solution, the following emulsion dispersant was used in an amount of 0.4 wt % based on the latex solids content.

Preparation of Photographic Material:

On the thus-prepared support, the back surface antihalation layer and the surface protective layer prepared above were coated, and on the opposite side, an emulsion layer and a surface protective layer were coated by the co-extrusion method. The emulsion surface had a coated silver amount of 2.7 g/m$^2$.

Evaluation of Photographic Capability:

The emulsion surface of each photographic material was exposed to light emitted from CRT for medical multi-camera (phosphor: P-45) so as to provide density gradient, for 1 second, and then processed as described in Example 2. As a result, it is verified that the light-sensitive materials and the processing solutions of the present invention exhibit excellent photographic capability.

EXAMPLE 4

Using respective emulsions prepared in Example 1 and by combining these emulsions of which grain size was adjusted to give an appropriate sensitivity, photographic materials having the same sensitivity and the same gradation as X-Ray Film SHRA 30, UR-1, UR-2 or UR-3 produced by Fuji Photo Film Co., Ltd. were prepared by the same coating method as in Example 1. Further, the photographic light-sensitive materials were evaluated in the same manner as in Example 1, and as a result, it is seen that the photographic light-sensitive materials are excellent also in the improvement of sharpness due to reduction of cross-over light, the granularity and the processing stability. Further, the cross-over light was measured by the method described in JP-A-1-172828, then, the cross-over light of the photographic light-sensitive materials of the present invention was 9% or less.

According to the present invention, a silver halide photographic light-sensitive material which is high in the sensitivity, reduced in the fog and excellent in the fixability, can be provided.

While the invention has been described in detail and with reference to specific embodiments thereof, it will be apparent to one skilled in the art that various changes and modifications can be made therein without departing from the spirit and scope thereof.

The entire contents of Japanese Application No. 8-96883 filed on Apr. 18, 1996 are hereby incorporated by reference.

What is claimed is:

1. A method for producing a silver halide emulsion comprising at least a dispersion medium and silver halide grains, wherein at least 30% of the entire projected area of the silver halide grains is occupied by tabular grains having {100} faces as major faces, an aspect ratio (diameter/thickness) of from 1.5 to 30 and forming a nucleus having a Br content of from 40 to 60 mol %, the coefficient of variation of the halogen composition distribution among the silver halide grains is 10% or less; and forming a tabular nucleus due to a halogen composition gap, wherein the tabular nucleus formation is carried out at a pAg of 8.0 to 10.0, and the growth of tabular nuclei is carried out after the pAg is reduced to 6.0 to 8.0;

wherein the growth portion has a halogen composition having a Br content of from 40 mol % to 60 mol %.

2. A method as claimed in claim 1, wherein the tabular grains have an I content of from 0 to 10 mol %.

3. A method as claimed in claim 1, wherein the coefficient of variation of the halogen composition distribution among the silver halide grains is from 0 to 7.5%.

4. A method as claimed in claim 1, wherein the coefficient of variation of the halogen composition distribution among the silver halide grains is from 0 to 6.5%.

5. The method of claim 1, wherein the tabular nucleus formation step comprises adding silver halide fine grains.

6. The method of claim 1, wherein the growth of the silver halide grains is carried out by adding fine grains containing silver halide fine grains capable of being removed by the completion of grain formation at a proportion of 90% or more in terms of number.

7. The method of claim 1, wherein the growth of the silver halide grains is carried out by adding fine grains containing silver halide fine grains capable of being removed by the completion of grain formation at a proportion of 90% or more in terms of number, and upon counting the fine grains added in order of larger volume, at least 50% by number of the fine grains added are fine grains having a volume of from 10 to 100% of a volume of a largest size fine grain capable of being removed by the completion of grain formation.

8. The method of claim 6, wherein the silver halide fine grains to be added at the growth of the silver halide grains are continuously prepared in a mixer provided in the vicinity of a reaction vessel by feeding thereto a silver nitrate solution and a halogen salt solution, wherein the fine grains are continuously added to the reaction vessel immediately after the preparation.

9. The method of claim 5, wherein the silver halide grains are obtained by undergoing a tabular nucleus formation process due to the halogen composition gap, the tabular nucleus formation is carried out at a pAg of from 8.0 to 10.0, and the growth of tabular nuclei is carried out after the pAg is reduced from 6.0 to 8.0, and wherein the silver halide fine grains to be added at the introduction of silver halogen gap are continuously added to a reaction vessel while continuously preparing the silver halide fine grains in a mixer provided in the vicinity of the reaction vessel by feeding thereto a silver nitrate solution and a halogen salt solution.

* * * * *